US012291955B2

(12) United States Patent
Al-Rubaii et al.

(10) Patent No.: US 12,291,955 B2
(45) Date of Patent: May 6, 2025

(54) REAL-TIME MODEL OF RIG AND BIT HYDRAULICS EFFICIENCY

(71) Applicant: SAUDI ARABIAN OIL COMPANY, Dhahran (SA)

(72) Inventors: Mohammed Murif Hassan Al-Rubaii, Dammam (SA); Saleh Mohammed Al-Harbi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 432 days.

(21) Appl. No.: 17/655,462

(22) Filed: Mar. 18, 2022

(65) Prior Publication Data

US 2023/0296010 A1 Sep. 21, 2023

(51) Int. Cl.
*E21B 44/02* (2006.01)
*E21B 44/00* (2006.01)

(52) U.S. Cl.
CPC ..... *E21B 44/00* (2013.01); *E21B 44/02* (2013.01); *E21B 2200/20* (2020.05)

(58) Field of Classification Search
CPC ..... E21B 44/02
See application file for complete search history.

(56) References Cited

U.S. PATENT DOCUMENTS 7,878,268 B2 2/2011 Chapman et al.
9,970,266 B2 5/2018 Marx et al.
(Continued)

FOREIGN PATENT DOCUMENTS

AU 2021101208 A4 5/2021
CN 104806226 B 8/2018
(Continued)

OTHER PUBLICATIONS

Pessier, R.C. et al., "Quantifying Common Drilling Problems With Mechanical Specific Energy and a Bit-Specific Coefficient of Sliding Friction"; Proceedings of the SPE Annual Technical Conference and Exhibition; Paper No. SPE-24584-MS; pp. 1-16; Oct. 4, 1992 (16 pages).
(Continued)

*Primary Examiner* — Giovanna Wright
(74) *Attorney, Agent, or Firm* — Osha Bergman Watanabe & Burton LLP

(57) ABSTRACT

A method for optimizing drilling performance of a drilling operation is discloses. The method includes determining, while advancing a drill bit during the drilling operation based on drilling parameters specified by a user, a rate of penetration (ROP), acquiring, using sensors disposed throughout a rig of a well, sensor measurement data related to circulation of drilling fluid, generating, using a drilling hydraulics model based on at least the sensor measurement data of the circulation of drilling fluid, modeled rig and bit hydraulics data, displaying, on a driller console of the rig, the modeled rig and bit hydraulics data as a real-time drilling hydraulics profile, in response to a user viewing the displayed real-time drilling hydraulics profile, receiving an adjustment to the drilling parameters from the user, and further performing the drilling operation based on the adjustment to optimize the ROP.

20 Claims, 16 Drawing Sheets

(56) References Cited

U.S. PATENT DOCUMENTS

| | | | | |
|---|---|---|---|---|
| 2003/0168257 | A1* | 9/2003 | Aldred | E21B 44/00 175/24 |
| 2009/0101410 | A1* | 4/2009 | Egilsson | B66D 1/485 175/24 |
| 2012/0059521 | A1* | 3/2012 | Iversen | E21B 44/00 700/275 |
| 2018/0012384 | A1* | 1/2018 | Marland | E21B 47/12 |
| 2019/0316457 | A1* | 10/2019 | Al-Rubaii | E21B 44/06 |
| 2020/0362686 | A1 | 11/2020 | Puwanto et al. | |
| 2021/0230981 | A1 | 7/2021 | Gupta et al. | |

FOREIGN PATENT DOCUMENTS

| | | | |
|---|---|---|---|
| CN | 111622735 | A | 9/2020 |
| KR | 102294384 | B1 | 8/2021 |
| WO | 2014/066981 | A1 | 5/2014 |

OTHER PUBLICATIONS

Lim, Kien Ming et al., "Bit Hydraulics Analysis for Efficient Hole Cleaning"; Proceedings of the SPE Western Regional Meeting; Paper No. SPE-35667-MS; pp. 1-6; May 22, 1996 (14 pages).

Nguyen, Desmond et al., "A Three-Layer Hydraulic Program for Effective Cuttings Transport and Hole Cleaning in Highly Deviated and Horizontal Wells"; SPE Drilling & Completion; vol. 13, Issue 3, Paper No. SPE-51186-PA; pp. 182-189; Sep. 1998 (8 pages).

Onome, Orogun Humphrey, "A Case Study on the Optimization of Hydraulic Horsepower for Efficient Bottom Hole Cleaning in Drilling"; Submitted in Parital fulfillment of the requirements for the degree of Masters of Engineering; Major Subject: Petroleum Engineering; Dalhousie University; pp. i-121; Dec. 2013 (141 pages).

Moslemi, Ali et al., "Study of the Hydraulic Performance of Drill Bits Using a Computational Particle-Trackings Method"; SPE Drilling & Completion; vol. 29, Issue 1, Paper No. SPE-169812-PA; pp. 28-35; Mar. 2014 (8 pages).

Al-Rubaii, Mohammed Murif et al., "A New Robust Drilling Rate Model"; Proceedings of the Offshore Technology Conference Brazil; Paper No. OTC-29933-MS; pp. 1-13; Oct. 28, 2019 (13 pages).

Braga, Daniel Cardoso, "Field Drilling Data Cleaning and Preparation for Data Analytics Applications"; LSU Master's Theses; Louisiana State University: LSU Digital Commons; pp. ii-123; Jun. 2019 (137 pages).

Al-Rubaii, Mohammed M. et al., "Real Time Automation of Cutting Carrying Capacity Index to Predict Hole Cleaning Efficiency and Thereby Improve Well Drilling Performance"; Proceedings of the 2021 SPE Annual Technical Conference and Exhibition; Paper No. SPE-206235-MS; pp. 1-6; Sep. 15, 2021 (6 pages).

* cited by examiner

REAL-TIME MODEL OF RIG AND BIT HYDRAULICS EFFICIENCY

BACKGROUND

Drilling hydraulics refers to how the drilling fluid in the circulating system exerts pressure throughout the system, particularly in the rig and drill bit. In this context, the drilling hydraulics is also referred to as the rig and bit hydraulics. The rig circulation system is composed of mud pumps which deliver drilling fluid (commonly referred to as "mud") from mud pits to hoses and pipes down to the bottom of the wellbore. Drilling mud is moved through the drill bit by injecting through nozzles on the drill bit into the annulus and returned back to solid control equipment and the mud pits.

SUMMARY

In general, in one aspect, the invention relates to a method for optimizing drilling performance of a drilling operation. The method includes determining, while advancing a drill bit during the drilling operation based on a plurality of drilling parameters specified by a user, a rate of penetration (ROP), acquiring, using a plurality of sensors disposed throughout a rig of a well, sensor measurement data related to circulation of drilling fluid, generating, using a drilling hydraulics model based on at least the sensor measurement data of the circulation of drilling fluid, modeled rig and bit hydraulics data, displaying, on a driller console of the rig, the modeled rig and bit hydraulics data as a real-time drilling hydraulics profile, in response to a user viewing the displayed real-time drilling hydraulics profile, receiving an adjustment to the plurality of drilling parameters from the user, and further performing the drilling operation based on the adjustment to optimize the ROP.

In general, in one aspect, the invention relates to a data gathering and analysis system for optimizing drilling performance of a drilling operation. The data gathering and analysis system includes a processor and a memory coupled to the processor and storing instruction, the instructions, when executed by the processor, having functionality for determining, while advancing a drill bit during the drilling operation based on a plurality of drilling parameters specified by a user, a rate of penetration (ROP), acquiring, using a plurality of sensors disposed throughout a rig of a well, sensor measurement data related to circulation of drilling fluid, generating, using a drilling hydraulics model based on at least the sensor measurement data of the circulation of drilling fluid, modeled rig and bit hydraulics data, displaying, on a driller console of the rig, the modeled rig and bit hydraulics data as a real-time drilling hydraulics profile, in response to a user viewing the displayed real-time drilling hydraulics profile, receiving an adjustment to the plurality of drilling parameters from the user, and further performing the drilling operation based on the adjustment to optimize the ROP.

In general, in one aspect, the invention relates to a wellsite for performing a drilling operation of a well. The wellsite includes a rig having a plurality of drilling equipment of the well installed with a plurality of sensors, and a data gathering and analysis system comprising functionality for determining, while advancing a drill bit during the drilling operation based on a plurality of drilling parameters specified by a user, a rate of penetration (ROP), acquiring, using a plurality of sensors disposed throughout a rig of a well, sensor measurement data related to circulation of drilling fluid, generating, using a drilling hydraulics model based on at least the sensor measurement data of the circulation of drilling fluid, modeled rig and bit hydraulics data, displaying, on a driller console of the rig, the modeled rig and bit hydraulics data as a real-time drilling hydraulics profile, in response to a user viewing the displayed real-time drilling hydraulics profile, receiving an adjustment to the plurality of drilling parameters from the user, and further performing the drilling operation based on the adjustment to optimize the ROP.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of the disclosure provide a method and a system that interpret downhole conditions utilizing a real-time model of rig and bit hydraulics efficiency. The rig and bit hydraulics efficiency model takes the drilling well data, fluids density and rheology, and drilling rate with others rig sensor measurements as inputs to generate and display hydraulics horsepower information as a real-time curve for the driller's assessment and intervention. The system provides drillers with continuous monitoring, evaluation, optimization, and recommendations regarding hydraulics performance and efficiency to mitigate hole problems and improve drilling rate. In particular, the model allows the drillers to optimize the drilling fluid hydraulics to circulate the cuttings to the surface and ensure smooth drilling rate relative to mud efficiency resulting in safer and economical wells.

Figure 1A:
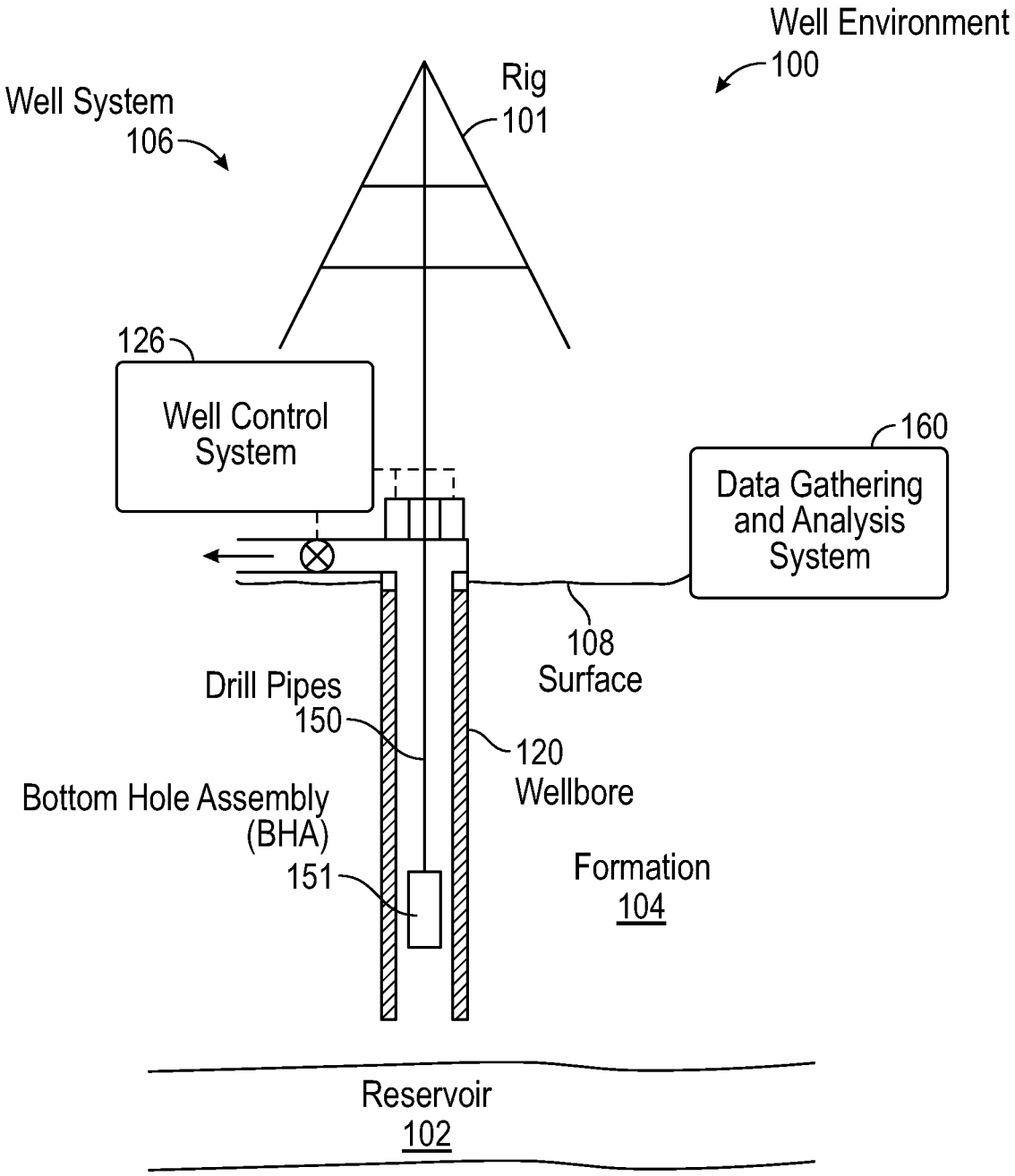
FIGS. 1A, 1B, and 2 show a system in accordance with one or more embodiments.

FIG. 1A shows a schematic diagram of a well environment in accordance with one or more embodiments. In one or more embodiments, one or more of the modules and/or elements shown in FIG. 1 may be omitted, repeated, and/or substituted. Accordingly, embodiments disclosed herein should not be considered limited to the specific arrangements of modules and/or elements shown in FIG. 1.

As shown in FIG. 1A, a well environment (100) includes a subterranean formation ("formation") (104) and a well system (106). The formation (104) may include a porous or fractured rock formation that resides underground, beneath the earth's surface ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120), a data gathering and analysis system (160), and a well control system ("control system") (126). The well control system (126) may control various operations of the well system (106), such as well production operations, well drilling operation, well completion operations, well maintenance operations, and reservoir monitoring, assessment and development operations. In some embodiments, the well control system (126) includes a computer system.

The rig (101) is the machine used to drill a borehole to form the wellbore (120). In one or more embodiments of the invention, the rig (101) performs hydraulic drilling operations. Major components of the rig (101) include the drilling fluid tanks, the drilling fluid pumps (e.g., rig mixing pumps), the derrick or mast, the draw works, the rotary table or top drive, the drill string, the power generation equipment and auxiliary equipment. Drilling fluid, also referred to as "drilling mud" or simply "mud," is used to facilitate drilling boreholes into the earth, such as drilling oil and natural gas wells. The main functions of drilling fluids include providing hydrostatic pressure to prevent formation fluids from entering into the borehole, keeping the drill bit cool and clean during drilling, carrying out drill cuttings, and suspending the drill cuttings while drilling is paused and when the drilling assembly is brought in and out of the borehole.

The wellbore (120) includes a bored hole (i.e., borehole) that extends from the surface (108) towards a target zone of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "downhole" end of the wellbore (120). The wellbore (120) may facilitate the circulation of drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the hydrocarbon-bearing formation (104) or the reservoir (102) during injection operations, or facilitate the communication of monitoring devices (e.g., logging tools) lowered into the formation (104) or the reservoir (102) during monitoring operations (e.g., during in situ logging operations).

In some embodiments, the well system (106) is provided with a bottom hole assembly (BHA) (151) attached to drill string (150) to suspend into the wellbore (120) for performing the well drilling operation. The bottom hole assembly (BHA) is the lowest part of a drill string and includes the drill bit, drill collar, stabilizer, mud motor, etc. A mud motor is a drilling motor that uses hydraulic horsepower of the drilling fluid to drive the drill bit during the drilling operation.

In some embodiments, the data gathering and analysis system (160) includes hardware and/or software with functionality for facilitating operations of the well system (106), such as well production operations, well drilling operation, well completion operations, well maintenance operations, and reservoir monitoring, assessment and development operations. For example, the data gathering and analysis system (160) may store drilling data records of drilling the wellbore (120) and associated offset wells (not shown). The drilling data records includes sensor data obtained throughout the well system (106). The data gathering and analysis system (160) may analyze the drilling data records to generate recommendations to facilitate drilling the wellbore (120) to improve the rate of penetration (ROP) with an optimized rig and bit hydraulics efficiency. In this context, the data gathering and analysis system (160) is referred to as a hydraulics efficiency optimization advisory system. While the data gathering and analysis system (160) is shown at a well site, embodiments are contemplated where at least a portion of the data gathering and analysis system (160) is located away from well sites. In some embodiments, the data gathering and analysis system (160) may include a computer system that is similar to the computer system (500) described below with regard to FIG. 5 and the accompanying description.

Figure 1B:
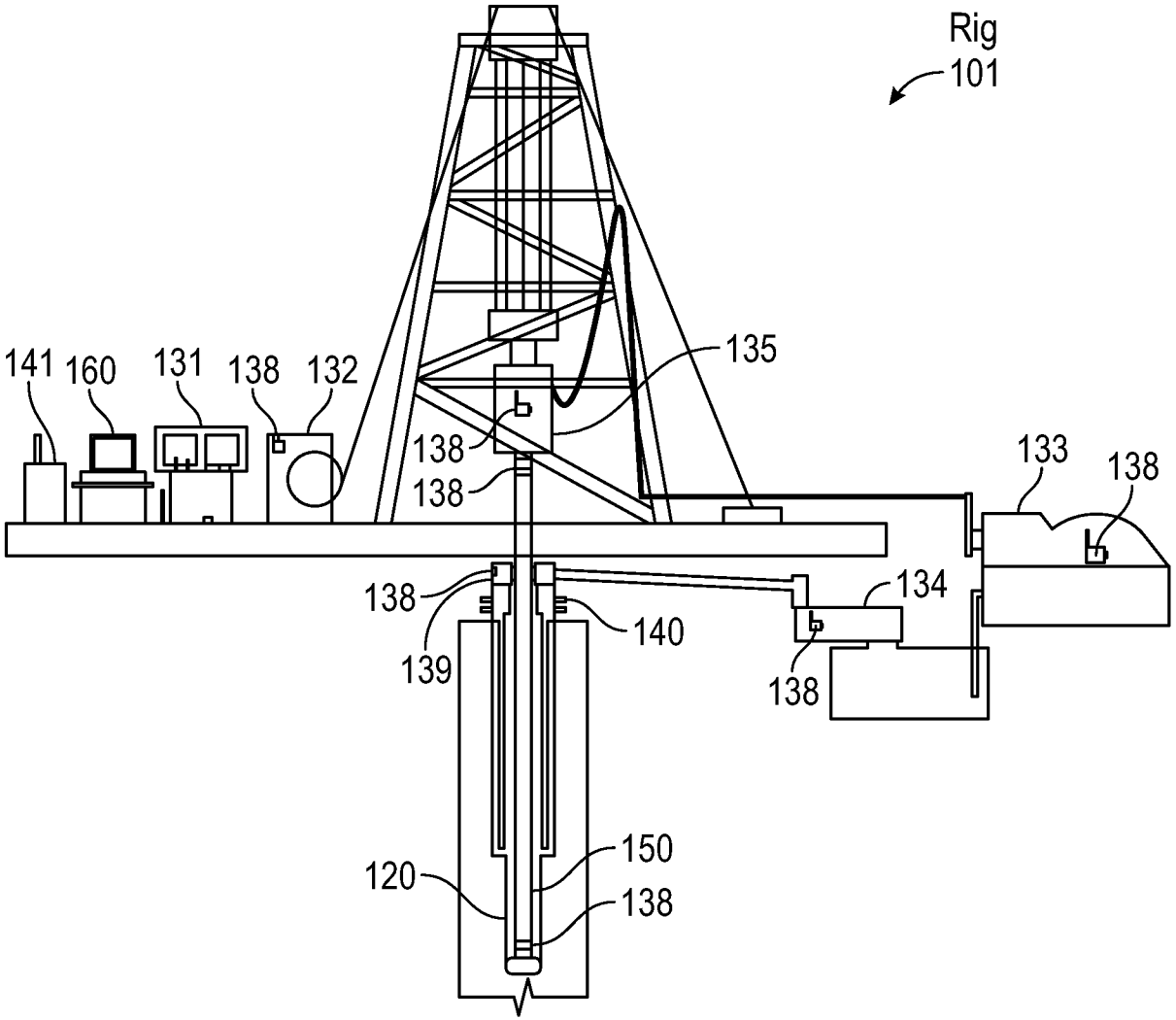

FIG. 1B shows details of the rig (101) depicted in FIG. 1A above. As shown in FIG. 1B, the rig (101) includes a driller console (131), drawworks (132), mud pumps (133), shale shakers (134), a top drive (135), the drill string (150), the wellbore (120), condition monitoring sensors (138), a rotating component device (139) for unconventional drilling operations, blowout preventer (140), and a communication unit (141). The condition monitoring sensors (138) include surface or subsurface sensors placed or installed on selected drilling equipment to monitor real-time conditions. For example, the condition monitoring sensors (138) may be place on the mud pumps (133), the shale shakers (134), the top drive (135), the drill string (150) (at surface or below surface), the rotating component device (139) and any other equipment of the rig (101) for drilling the wellbore (120). In some embodiments, the condition monitoring sensors (138) are grouped into multiple condition monitoring packages and placed in multiple sets of drilling equipment. Each of the condition monitoring sensors (138) is capable of acquiring parameters (i.e., measurement data) related to the condition and environment of the associated equipment during the drilling operation. For example, the measurement data may include drilling fluids density, rheology, rate of penetration (ROP), etc.

Measurement data from installed subsurface sensors are transmitted back to the surface for analysis using telemetry systems, such as through a wired pipe or wireless (e.g., acoustic, mud pulse, electromagnetic, etc.) telemetry. Measurement data generated by surface sensors or received from subsurface sensors are both transmitted to the data gathering and analysis system (160) via wired or wireless communication, such as Bluetooth, Wi-Fi, mobile broadband, near field communications, Global System for Mobile Communications (GSM), etc. In some embodiments, a combination of two or more communication methods may be used, e.g., Wi-Fi and cable combination; near field communication, cable, and GSM combination, etc. In addition, the condition monitoring sensors (138) may be powered by embedded batteries, by wired power connections, or by energy harvesting method such as fluid turbines, solar panels, wind turbines, etc.

To facilitate the drilling hydraulics efficiency optimization, the data gathering and analysis system (160) collects measurement data from surface and subsurface sensors among all condition monitoring sensors (138). In some embodiments, the measurement data from at least some sensors are streaming constantly to the data gathering and analysis system (160). In addition to or alternatively, the measurement data from other sensors are inputted periodically to the data gathering and analysis system (160). In some embodiments, the data gathering and analysis system (160) uses artificial intelligent methods, such as machine learning and deep learning models, to determine any non-linear relationships between conditions of certain drilling equipment and the drilling hydraulics efficiency. In some embodiments, at least a portion of the measurement data are sent to remote computing resources using the communication unit (141). In such embodiments, analysis of the measurement data may also be performed in the Cloud, edge/fog servers, or using remote computer servers. Accordingly, analysis results from the remote computing resources are sent back to the rig (101) with via the communication unit (141).

In some embodiments, the communication unit (141) further communicates analysis results from the data gathering and analysis system (160) to the driller console (131) used by the driller (i.e., a human operator in a drilling team, drilling technician or foreman) to input the drilling parameters into the well control system (126) depicted in FIG. 1A above. The drilling parameters may include one or more parameters listed in TABLEs 1-3 below, such as WOB, RPM, Flow Rate, OH, MW, PV, ROP, Dn, YP, DP, PO, RD, MPE, ME,VE, SL, SPM, depth, SPP, etc. The analysis results may be presented by the driller console (131) to the driller using a graphical and/or audible user interface.

In some embodiments, the analysis results include drilling parameter inputs (e.g., target values of the drilling parameters) that are directly sent to automated or semi-automated drilling equipment by the communication unit (141) without action or intervention from the driller. In some other embodiments, a confirmation from the driller is required before the drilling parameter inputs from the communication unit (141) are accepted by the automated/semi-automated drilling equipment.

Figure 2:
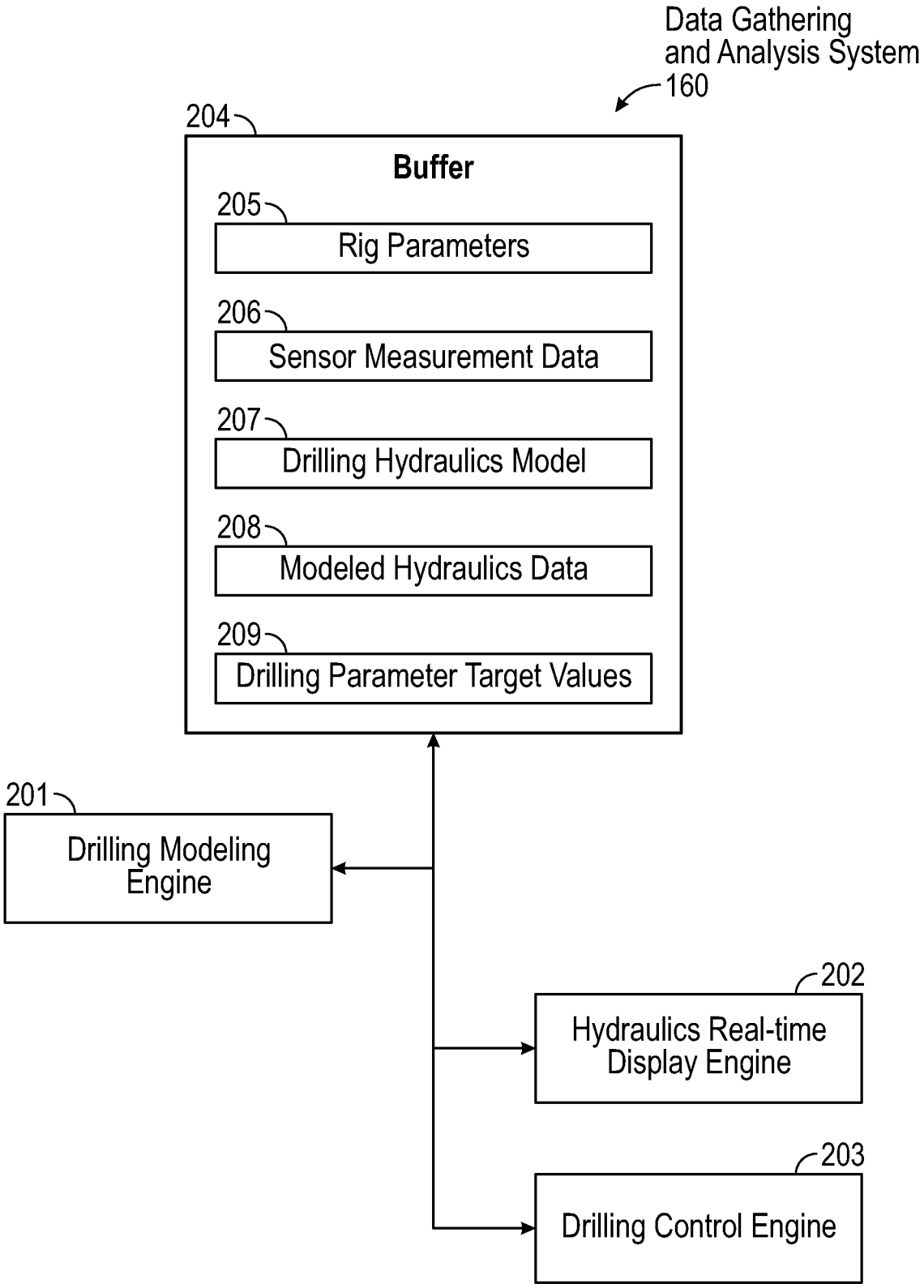

Turning to FIG. 2, FIG. 2 shows a schematic diagram of the data gathering and analysis system in accordance with one or more embodiments. In one or more embodiments, one or more of the modules and/or elements shown in FIG. 2 may be omitted, repeated, and/or substituted. Accordingly, embodiments of the disclosure should not be considered limited to the specific arrangements of modules and/or elements shown in FIG. 2.

FIG. 2 illustrates the data gathering and analysis system (160), as depicted in FIG. 1A above, that has multiple components, including, for example, a buffer (204), a drilling modelling engine (201), a hydraulics real-time display engine (201), and a drilling control engine (203). Each of these components (201, 202, 203, 204) may be located and executed on a same computing device (e.g., a general purpose personal computer (PC), laptop, tablet PC, smart phone, multifunction printer, kiosk, server, etc.) or on different computing devices that are connected via a network, such as a wide area network or a portion of Internet of any size having wired and/or wireless segments. Each of these components of the data gathering and analysis system (160) is discussed below.

In one or more embodiments disclosed herein, the data gathering and analysis system (160) performs real-time rig & bit hydraulics efficiency optimization to enhance well drilling and rig performance using real-time algorithms based on data mining techniques.

In one or more embodiments, the buffer (204) may be implemented in hardware (i.e., circuitry), software, or any combination thereof. The buffer (204) is configured to store data generated and/or used by the data gathering and analysis system (160). The data stored in the buffer (204) includes rig parameters (205), sensor measurement data (206), drilling hydraulics model (207), modeled hydraulics data (208), and drilling parameter target values (209).

The rig parameters (205) are structural parameters of the rig (101) depicted in FIGS. 1A-1B. For example, the rig parameters (205) may include data listed in TABLE 1 below.

TABLE 1

| | |
|---|---|
| Dn | Nozzle size of the $n^{th}$ nozzle of the drill bit in multiplies of 1/32 inch (in) |
| DP or $OD_{pipe}$ | Drill-pipe outer diameter (in) |
| OH or Hole Size | Open hole diameter (in) |
| TFA | Total flow area of nozzles ($in^2$) |
| MW | Mud weight (pounds per gallon (PPG) or pounds per cubic ft (PCF)) |
| POP | Mud pump volume output per stroke (barrel (bbl)/stroke) |
| RD | Rod diameter (in) |
| MPE | Mud pump efficiency |
| ME | Mechanical efficiency (in the range of 0.9-0.97) |
| VE | Volumetric efficiency (in the range of 0.95-1) |
| SL | Stroke length of mud pump (in) |
| SPM | Stroke per minute of mud pump |

The sensor measurement data (206) are measurement data acquired by condition monitoring sensors disposed throughout the well system (106) and the rig (101), such as the condition monitoring sensors (138) depicted in FIG. 1B. The sensor measurement data (206) may include data listed in TABLE 2 below.

TABLE 2

| | |
|---|---|
| CC | Cutting concentrations loaded in annulus. |
| GPM or $GPM_{mp}$ | The mud pump flow rate (gallon/min) |
| BHHP | Hydraulic horsepower of bit (hp) |
| dPb or dP(bit) | The pressure drop at the drilling bit (psi) |
| PV | Plastic viscosity (cp) |
| ROP | Rate of penetration (ft/hr) |
| RPM | Revolutions per minute |
| Vann | The annular velocity (ft/min) |
| Vn | Nozzle velocity (ft/sec) |
| WOB | Weight on bit (Klb) |
| YP | Yield point (lb/100 sqft) |
| T or TRQ | Torque (ft-lb) |
| MSE | Mechanical Specific energy (Psi) |
| DSE | Drilling Specific energy (Psi) |
| EMW | Equivalent Mud Weight with cuttings generated while drilling (PCF) |
| Fj | The Jet Impact Force (lb) |

The drilling hydraulics model (206) is a computerized model that generates the modeled hydraulics data (208) based on the rig parameters (205) and the sensor measurement data (206). In one or more embodiments, the drilling hydraulics model (206) computes the modeled hydraulics data (208) using real-time algorithmic equations to provide a hydraulics profile in real-time based on the modeled hydraulics data (208).

The modeled hydraulics data (208) is real-time output result of the drilling hydraulics model (207). The modeled hydraulics data (208) may include data listed in TABLE 3 below.

TABLE 3

| | |
|---|---|
| HSI | Hydraulic horsepower per square inch (hp/in$^2$) |
| BHHP | Bit hydraulic horsepower (hp) |
| BHSI | Bit hydraulic horsepower per square inch (hp/in$^2$) |
| RHHP | Rig hydraulic horsepower (hp) horsepower |
| RHSI | Pump hydraulic horsepower square inch (hp/in2) |
| JIFSI | The influence of jet impact force in bit per inch square, |
| FSI | Jet impact force caused by bit nozzles |

The drilling parameter target values (208) are a set of values of drilling control parameters (e.g., WOB, RPM, Flow Rate, etc.) that, when applied to the drilling equipment, will lead to an optimal result of the drilling hydraulics efficiency and drilling performance measure.

In one or more embodiments, the drilling modelling engine (201), the hydraulics real-time display engine (202), and the drilling control engine (203) may be implemented in hardware (i.e., circuitry), software, or any combination thereof.

In one or more embodiments, the drilling modelling engine (201) is configured to generate the modeled hydraulics data (207) by applying machine learning or deep learning algorithms to the sensor measurement data (205) and the drilling hydraulics model (206).

In one or more embodiments, the hydraulics real-time display engine (202) is configured to display the modeled hydraulics data (208) as a real-time hydraulics profile that allows the driller to continuously monitor, evaluate, and advise hydraulics efficiency while drilling to avoid hole problems and to optimize well drilling & rig performance. For example, the real-time hydraulics profile may be displayed on the driller console (131) depicted in FIG. 1B above. The displayed real-time hydraulics profile provides the driller in real-time indication regarding hole cleaning evaluation and ROP performance optimization. Accordingly, the driller may initiate immediate intervention during drilling when the wellbore is not being cleaned properly by the circulating drilling fluid.

In one or more embodiments, the drilling control engine (203) is configured to generate target values of the drilling parameters (e.g., WOB, RPM, Flow Rate, etc.) to optimize a pre-determined performance measure (e.g., rate of penetration, hydraulics efficiency, etc.) of the drilling operation. In one or more embodiments, the target values of the drilling parameters are generated by the drilling control engine (203) based on input from the driller. In one or more embodiments, at least a part of the target values of the drilling parameters are generated by the drilling control engine (203) based on artificial intelligence and/or machine learning algorithms. Accordingly, the target values of the drilling parameters may be provided to the well control system (126) depicted in FIG. 1A above.

In one or more embodiments, the data gathering and analysis system (160) performs the functionalities described above using the method described in reference to FIGS. 3A and 3B below. Although the data gathering and analysis system (160) is shown as having three engines (201, 202, 203), in other embodiments of the invention, the data gathering and analysis system (160) may have more or fewer engines and/or more or fewer other components. Further, the functionality of each component described above may be split across components. Further still, each component (201, 202, 203) may be utilized multiple times to carry out an iterative operation.

Figure 3A:
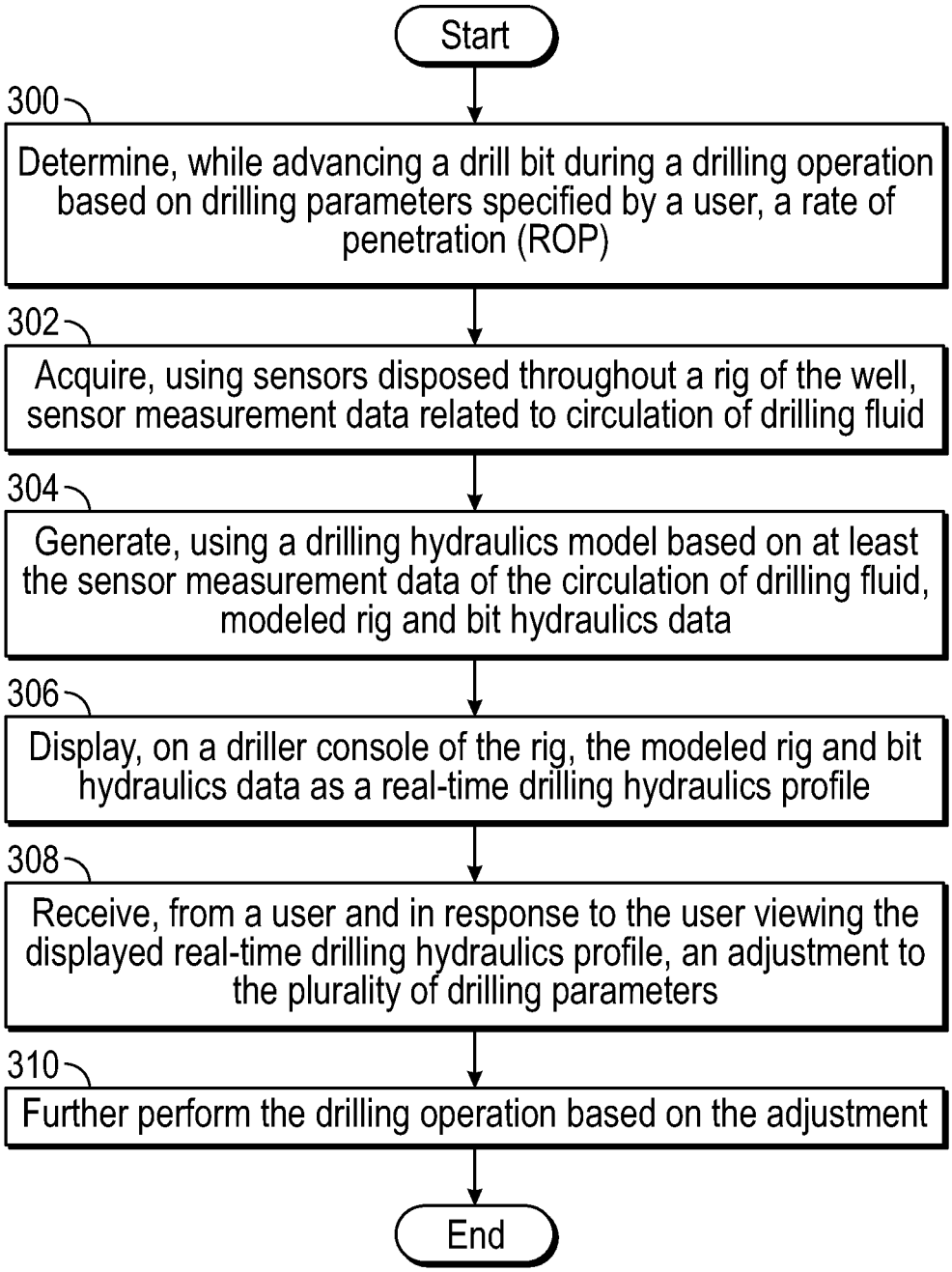
FIGS. 3A and 3B show a flowchart in accordance with one or more embodiments.
Figure 3B:
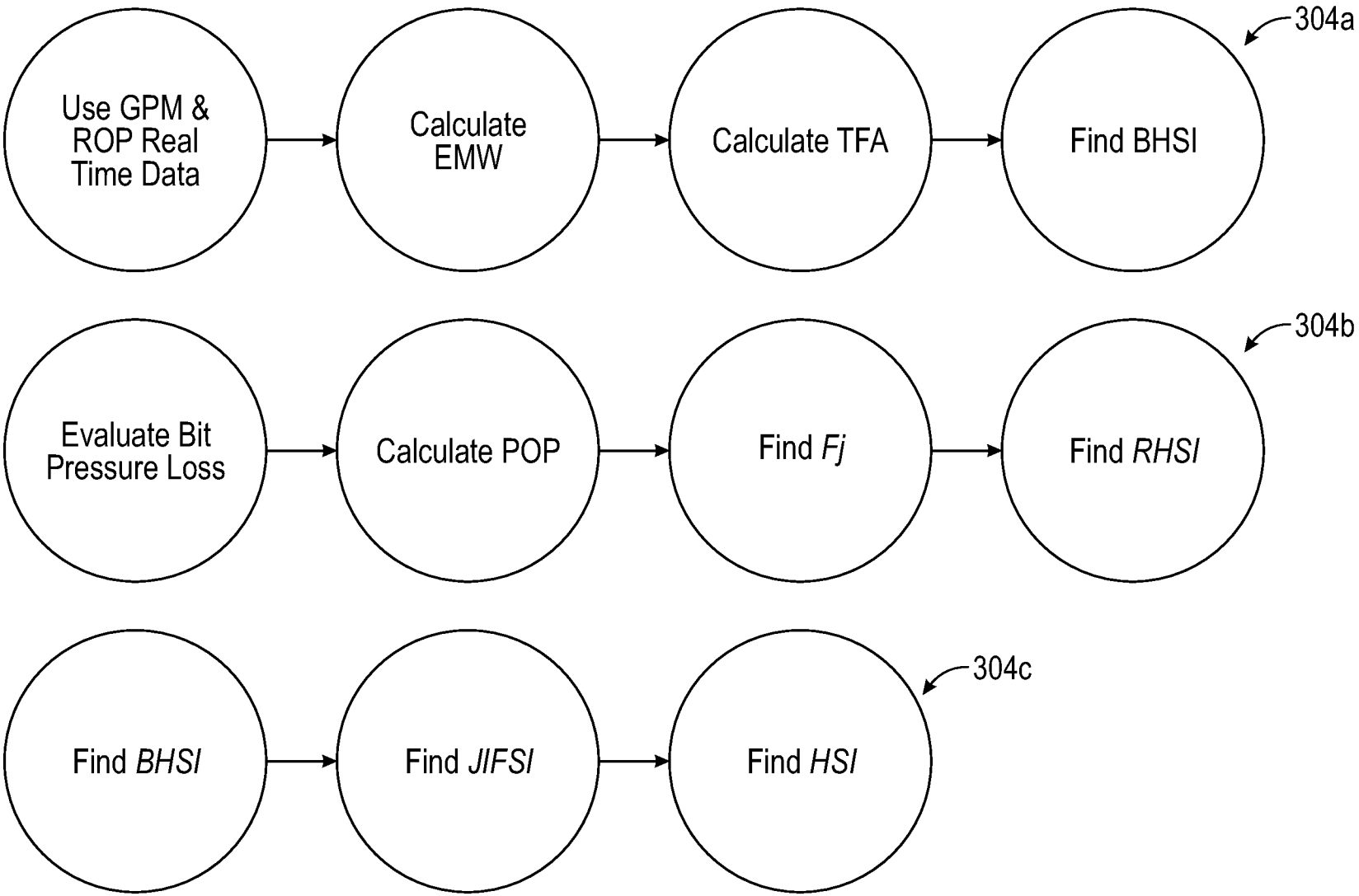

Turning to FIG. 3A, FIG. 3A shows a flowchart in accordance with one or more embodiments. Specifically, FIG. 3A describes a method of optimizing drilling hydraulics and performance of a drilling operation. One or more blocks in FIG. 3A may be performed using one or more components as described in FIGS. 1A, 1B, and 2. While the various blocks in FIG. 3A are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially in Block 300, a drill bit is advanced during a drilling operation. The drilling operation is performed based on drilling parameters (e.g., WOB, RPM, Flow Rate, etc.) specified by a user (e.g., by a drilling technician via a driller console). The rate of penetration (ROP) is determined using a downhole sensor.

In Block 302, rig parameters and measurement data of each drilling equipment of the drilling operation is acquired using sensors disposed on multiple pieces of drilling equipment of the well. For example, condition monitoring sensors may be disposed on mud pumps, shale shakers, the top drive, the drill string (at surface or below surface), the rotating component device, and any other equipment of the drilling rig. The conditions of the drilling equipment may correspond to the parameters listed in TABLEs 1-3 above and further include one or more of standpipe pressure, return flow rate, bit condition, hole cleaning index, equivalent circulating density (ECD), top-drive torque, top-drive hydraulics and electronics condition, stuck-pipe index, surface and downhole drill string vibration, bottomhole-assembly condition, drilling mud properties, and hole geometry.

In Block 304, modeled rig and bit hydraulics data are generated using a drilling hydraulics model based on at least the sensor measurement data of the circulation of drilling fluid. In one or more embodiments, the modeled rig and bit hydraulics data listed in TABLE 3 above are generated based on the rig parameters and the rig sensor measurement data listed in TABLES 1 and 2 above. Block 304 is divided into three parts, namely Block 304*a*, Block 304*b*, and Block 304*c*, that are shown as bubble diagrams in FIG. 3B and described in detail below.

In the first part of Block 304 (i.e., Block 304*a*), the drilling hydraulics model is used to compute modeled bit hydraulic horsepower per square inch (BHSI) based on GPM and POP real-time data using the following equations. In one or more embodiments, EMW and TFA are computed as intermediate results in the following equations. In these equations, numerical coefficients may be derived empirically and include physics based conversion factors.

$$POP = 3\left(\frac{RD^2}{1029.4}\frac{SL}{12}\right) \text{ triplex pump} \quad \text{Eq. (1A)}$$

$$POP = 2\left(\frac{RD^2}{1029.4}\frac{SL}{12}\right) \text{ duplex pump} \quad \text{Eq. (1B)}$$

$$GPM = \left(3\left(\frac{RD^2}{1029.4}\frac{SL}{12}\right)\right)SPM\ (42 \text{ gallon/barrel}) = POP * SPM * 42, \text{ triplex pump} \quad \text{Eq. (2A)}$$

-continued $$GPM = \left(2\left(\frac{RD^2}{1029.4}\frac{SL}{12}\right)\right)SPM\ (42),\ \text{duplex pump} \quad \text{Eq. (2B)}$$

$$CC = 0.00136\ \frac{ROP * OH^2}{GPM} \quad \text{Eq. (3)}$$

$$EMW = MW\ (CC) + MW = MW * (CC + 1) \quad \text{Eq. (4)}$$

$$dP(\text{bit}) = EMW\ (ppg)\frac{GPM^2}{12031\ 0.95^2 TFA^2}\ \text{for bit having same size nozzles} \quad \text{Eq. (5A)}$$

$$dP(\text{bit}) = EMW\ (PCF)\frac{GPM^2}{81000\ TFA^2}\ \text{for bit having same size nozzles} \quad \text{Eq. (5B)}$$

$$TFA = 0.00342\sqrt{\frac{MW * GPM^2}{dPb}} \quad \text{Eq. (6A)}$$

$$TFA = \frac{3.14}{4}\ n\ (\text{number of nozzels})\left(\frac{Dn(\text{size of nozzel})}{32}\right)^2\ \text{for bit having same size nozzles} \quad \text{Eq. (6B)}$$

$$TFA = \frac{3.14}{4}\ \Sigma ni\left(\frac{di}{432}\right)^2 = \frac{3.14}{4}\left(n1\left(\frac{d1}{32}\right)^2 + n2\left(\frac{d2}{32}\right)^2 + n3\left(\left(\frac{d3}{32}\right)^2 + \cdots\ ni\left(\frac{di}{32}\right)^2\right)\right)\ \text{for bit having different size nozzles} \quad \text{Eq. (6C)}$$

$$Dn = 32\sqrt{\frac{4\ TFA}{n\ \pi}} \quad \text{Eq. (7)}$$

(This is used once if $TFA$ known to optimize jet nozzle size selections that will minimize stand pipe pressure to avoid mud pump shutdown)

$$BHHP = \frac{dPb * GPM}{1714\ MPE} \quad \text{Eq. (8)}$$

$$BHSI = \frac{1.27\ BHHP}{OH^2} \quad \text{Eq. (9)}$$

In the second part of Block 304 (i.e., Block 304*b*), the drilling hydraulics model is used to compute modeled rig hydraulic horsepower per square inch (RHSI) based on bit pressure loss data using the following equations. In one or more embodiments, POP and Fj are computed as intermediate result in the following equations. In these equations, numerical coefficients may be derived empirically and include physics based conversion factors. Fj=(0.00633 GPM (dPb*EMW)$^{0.5}$ Eq. (10)

$$RHSI = \frac{1.27\ (SPP - dpb)GPM}{1714\ MPE * OH^2} \quad \text{Eq. (11)}$$

("SPP" denotes stand pipe pressure, i.e., total frictional pressure drop in the hydraulic circuit)

$$V_{ann} = \frac{24.5GPM}{\text{Hole size}^2 - OD_{pipe}^2} \quad \text{Eq. (12)}$$

$$V_n = 0.32086\frac{GPM_{mp}}{TFA} \quad \text{Eq. (13)}$$

In Block 305, the drilling hydraulics model is used to compute modeled hydraulic horsepower per square inch (HSI) based on BHSI using the following equations. In one or more embodiments, JIFSI is computed as intermediate result in the following equations. In these equations, numerical coefficients may be derived empirically and include physics based conversion factors.

$$JIFSI = \frac{1.27\ FSI * GPM}{1714\ MPE * OH^4} \quad \text{Eq. (14)}$$

$$HSI1 = \frac{RHSI}{\left(JIFSI\frac{SPPx}{SPP1} + BHSI\frac{depthx}{depth1}\right)} \quad \text{Eq. (15)}$$

(SPPx is variable SPP while drilling from real time sensor readings, SSP1 is the first reading during drilling, Depth1 is starting depth of drilling and depthx is variable depth while drilling from real time sensor readings)

A new Real-time Model for $$HSI\left(\frac{\text{hp}}{\text{in}^2}\right)\ \&\ FSI\ (Ib/\text{in}^2)$$

is described in the following equations. In these equations, numerical coefficients may be derived empirically and include physics based conversion factors.

$$HSI2 = \frac{(MW * CCA + MW)\ GPM^{32}\ (SPPx)(1 + RPMx)\ YP}{106.6 \times 10^6\ (TFA^2)(OH^2)\ (SPP1)(1 + RPM1)\ PV} \quad \text{Eq. (16)}$$

$$FSI = \frac{2.22 \times 10^{-5}(MW * CCA + \text{MW})\ GPM^2\ (SPPx)(1 + RPMx)\ YP}{OH^2\ TFA\ (SPP1)(1 + RPM1)PV} \quad \text{Eq. (17)}$$

$$HSI\ (avg) = 0.5(HSI1 + HSI2) \quad \text{Eq. (18)}$$

In the third part of Block 304 (i.e., Block 304*c*), the real-time drilling hydraulics profile is generated based on the modeled hydraulics data (e.g., BHSI, RHSI, HIS) and displayed for viewing by the driller to continuously evaluate the hydraulics efficiency.

In Block 308, the driller determines any adjustments (i.e., target values) to the drilling parameters accordingly. For example, the driller may determine target values of the drilling parameters such that the modeled HIS falls within the range listed in TABLE 4 below according to the hole size.

TABLE 4

| HSI (hp/sq. in) | Hole Size (OH) (in) |
|---|---|
| 1.5-3.5 | less than 8.5 |
| 3.5-6.5 | 8.5 < OH < or = 17.5 |
| 5.5-7.5 | OH > 17.5 |

In Block 310, the drilling operation is further performed based on the target values of the drilling parameters. As the drill bit advances during the drilling operation, the modeled hydraulics data (e.g., BHSI, RHSI, HIS) are continuously updated based on real-time condition monitoring sensor measurement data. Accordingly, the target values of the drilling parameters evolve in real-time to optimize the hydraulics efficiency and the drilling operation.

Figure 4A:
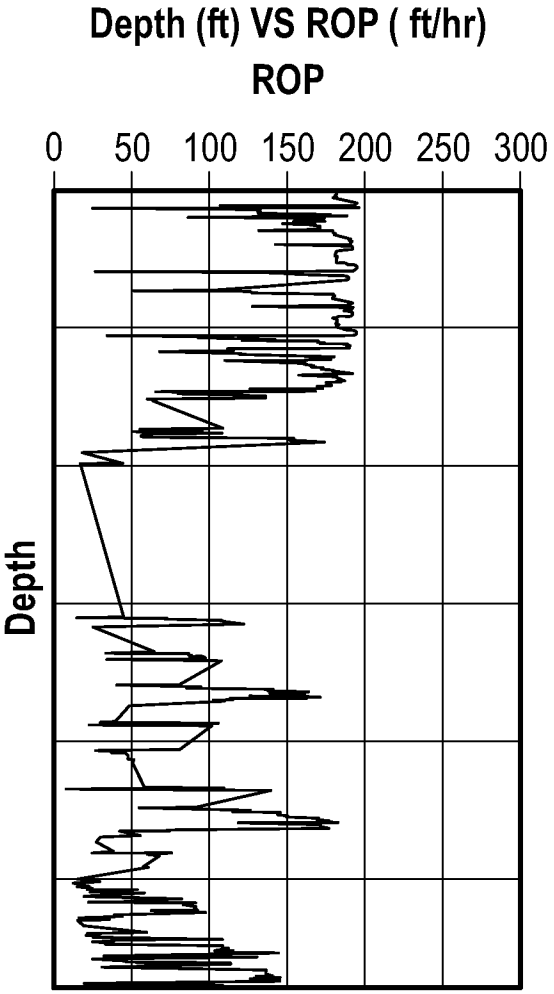
FIGS. 4A, 4B, 4C, 4D, 4E, 4F, 4G, 4H, 4I, 4J, 4K, 4L, 4M, 4N, 4O, 4P, and 4Q show examples in accordance with one or more embodiments.
Figure 4B:
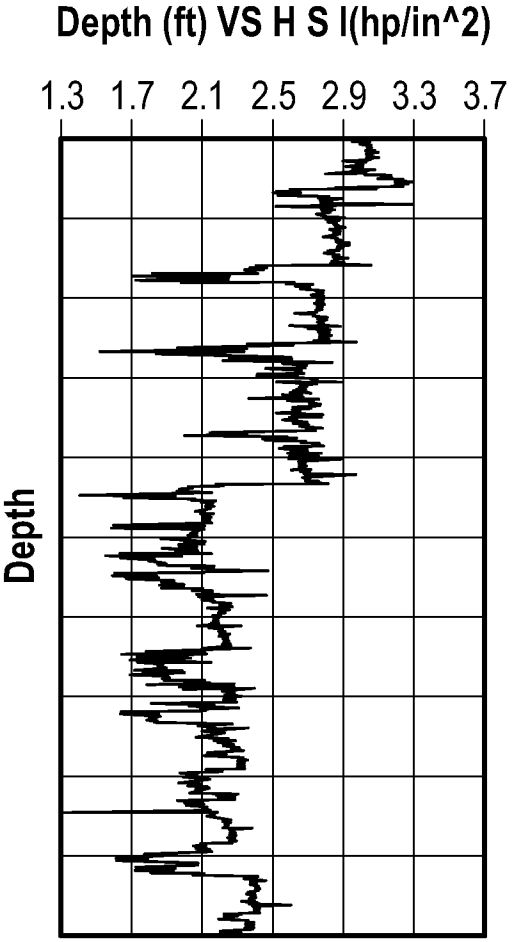
Figure 4C:
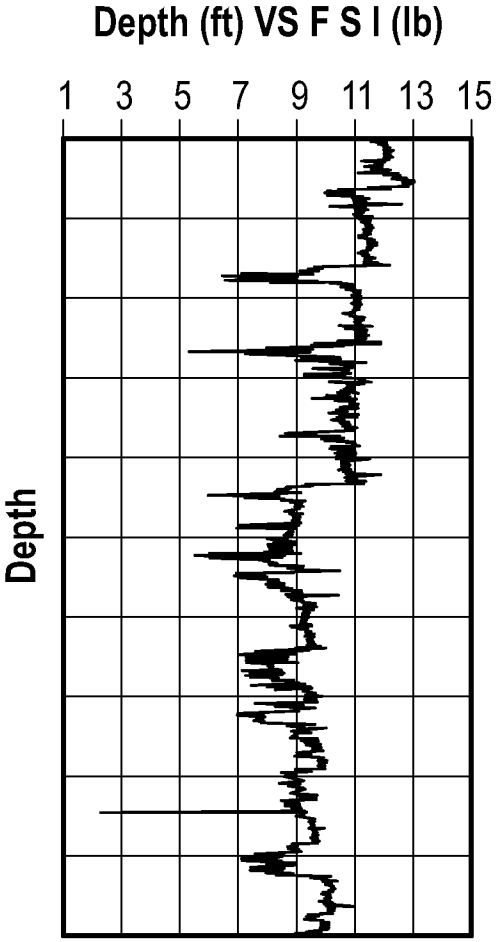
Figure 4F:
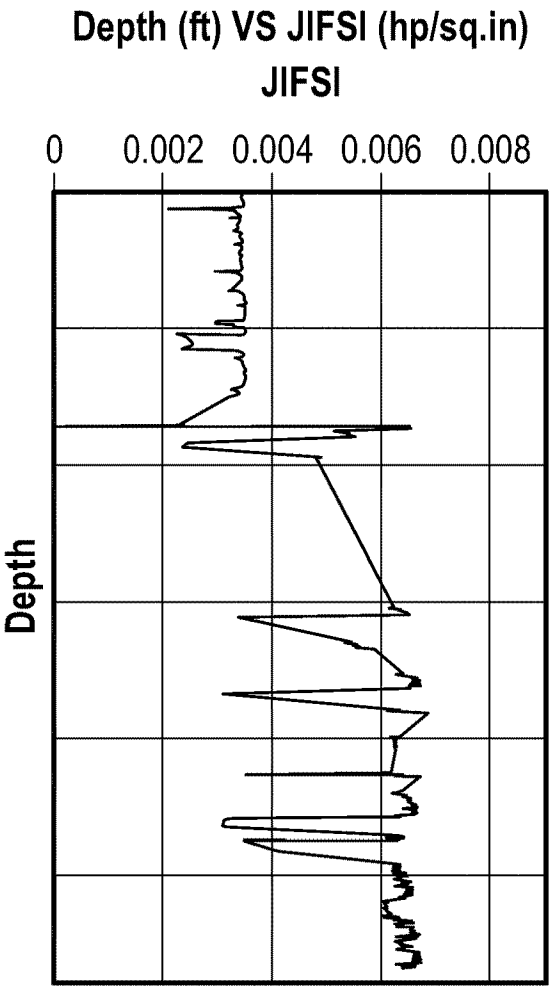
Figure 4E:
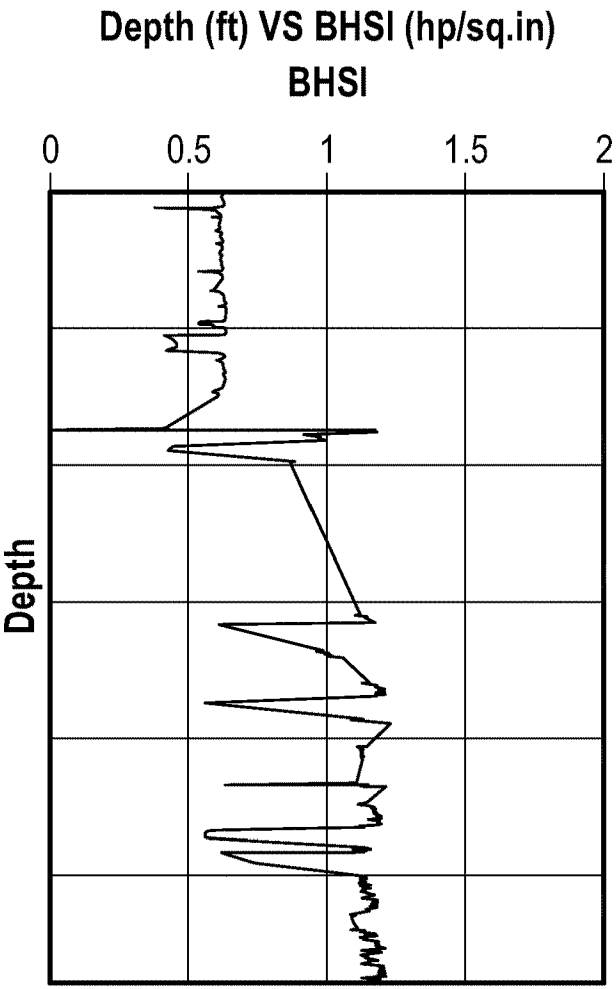
Figure 4D:
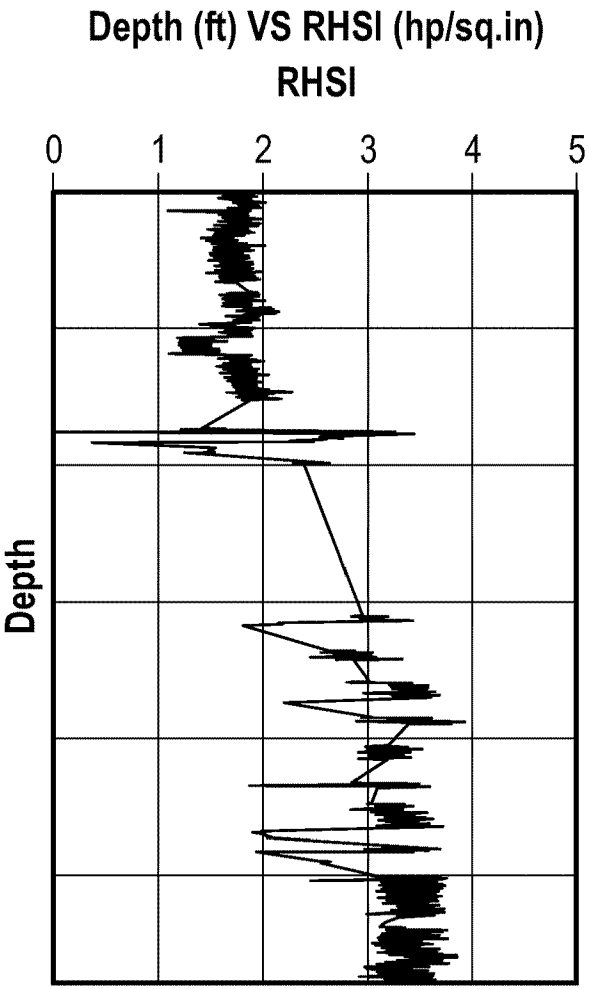
Figure 4G:
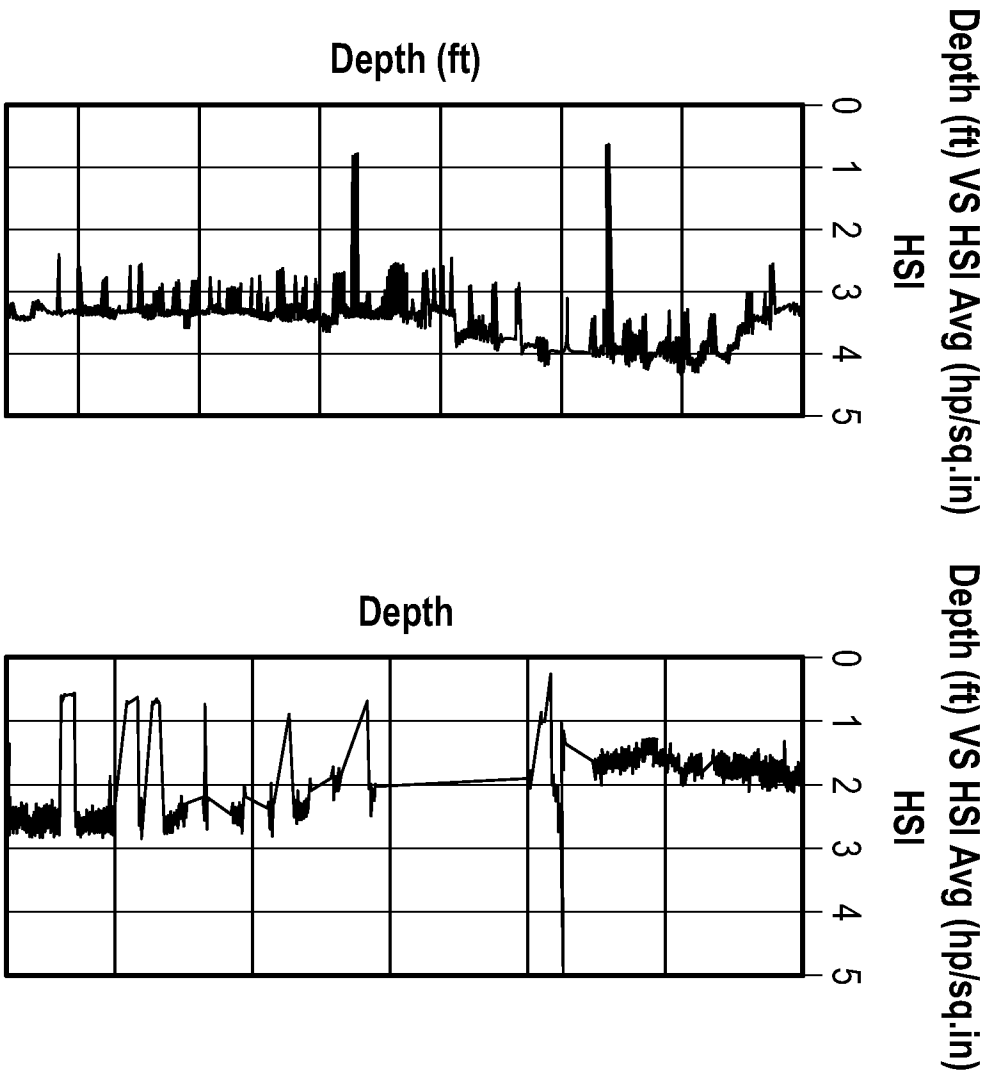
Figure 4H:
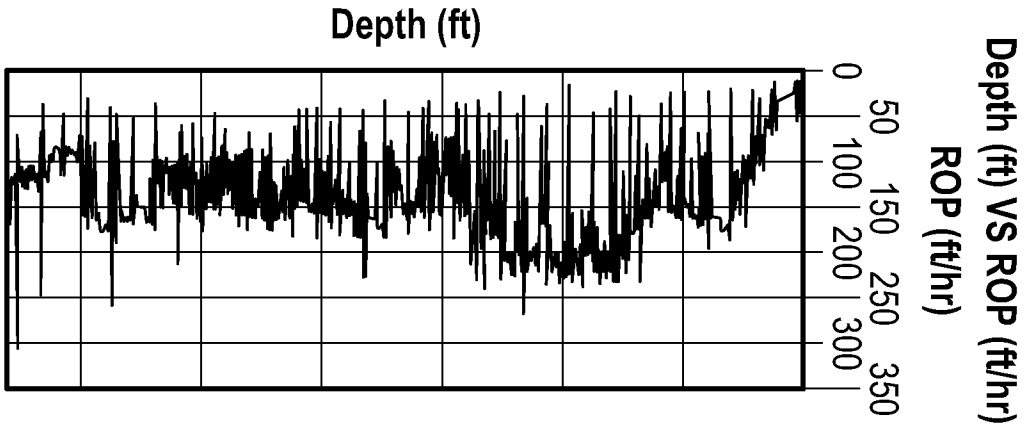
Figure 4H:
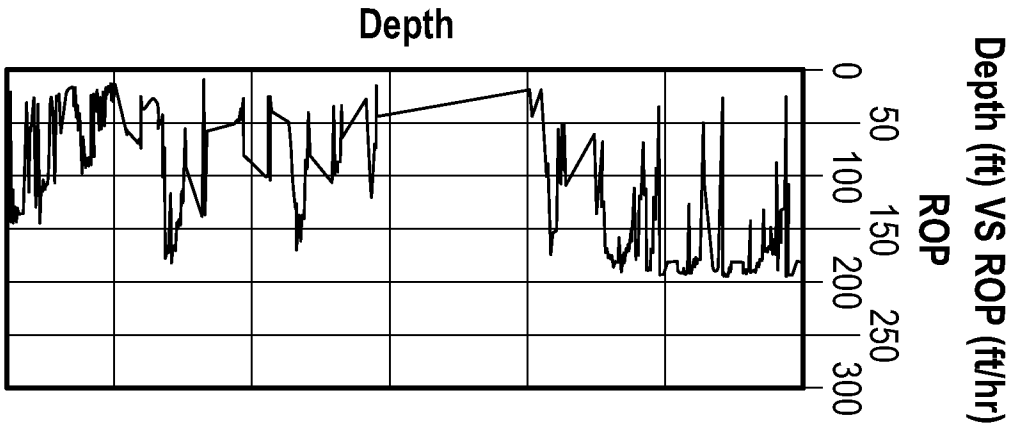
Figure 4J:
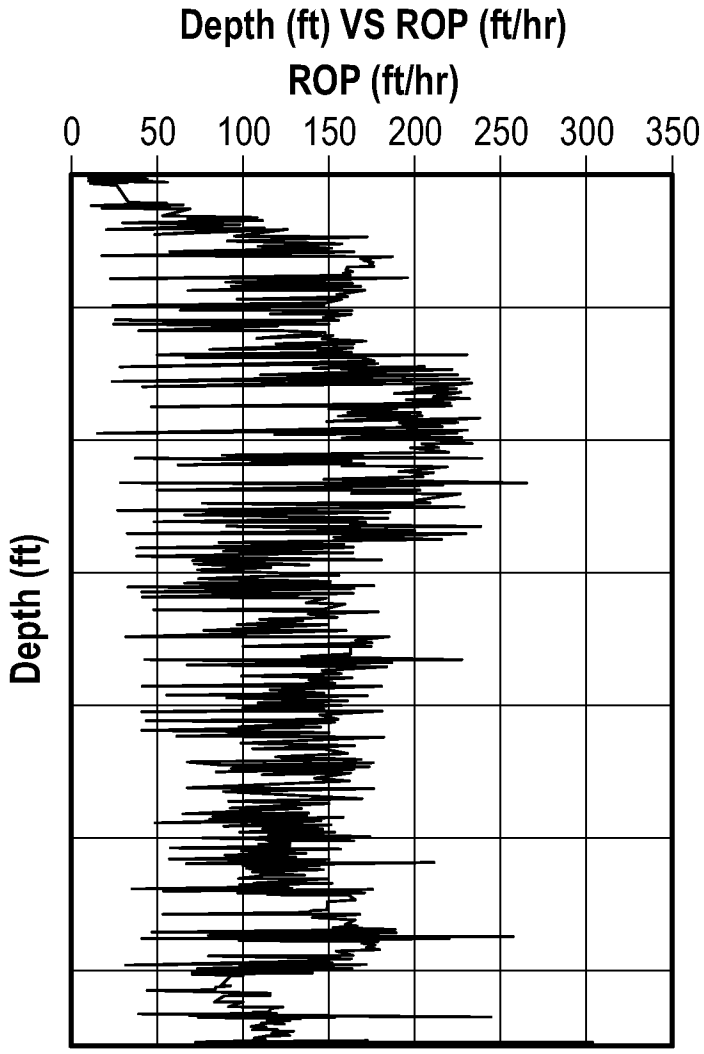
Figure 4I:
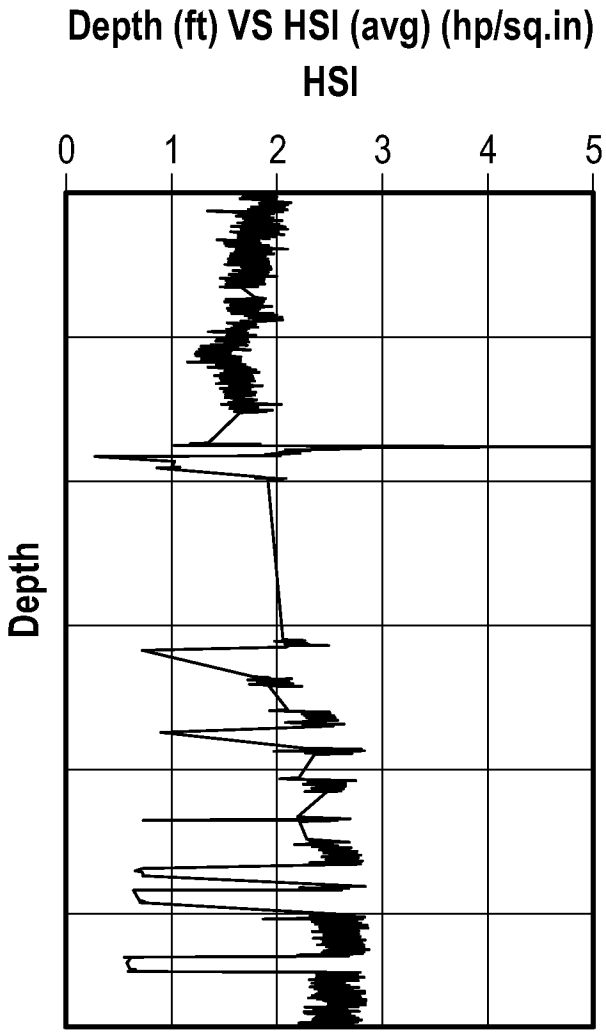
Figure 4L:
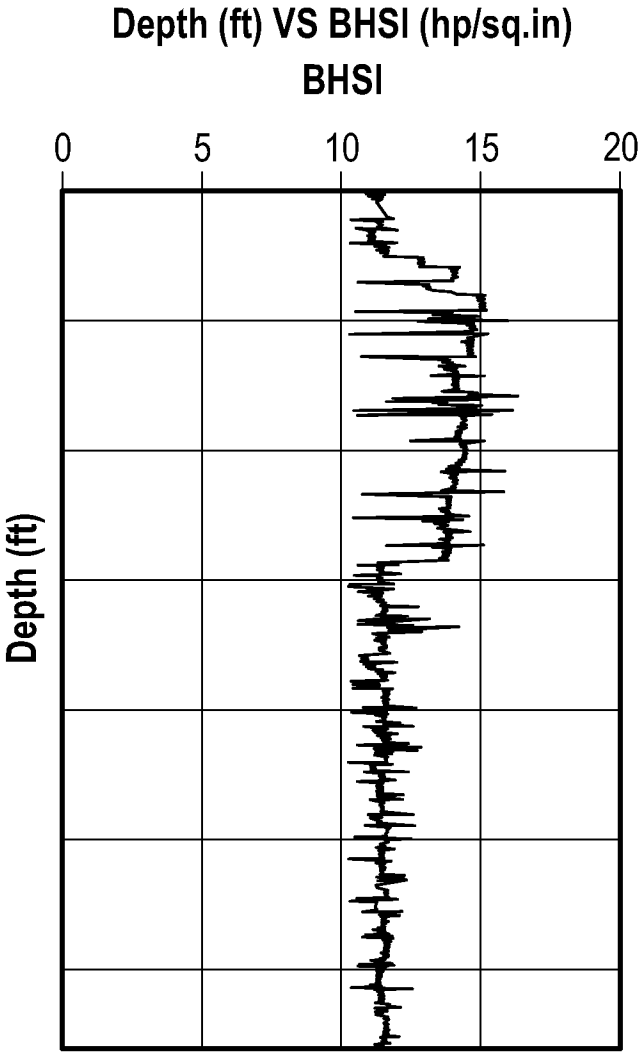
Figure 4K:
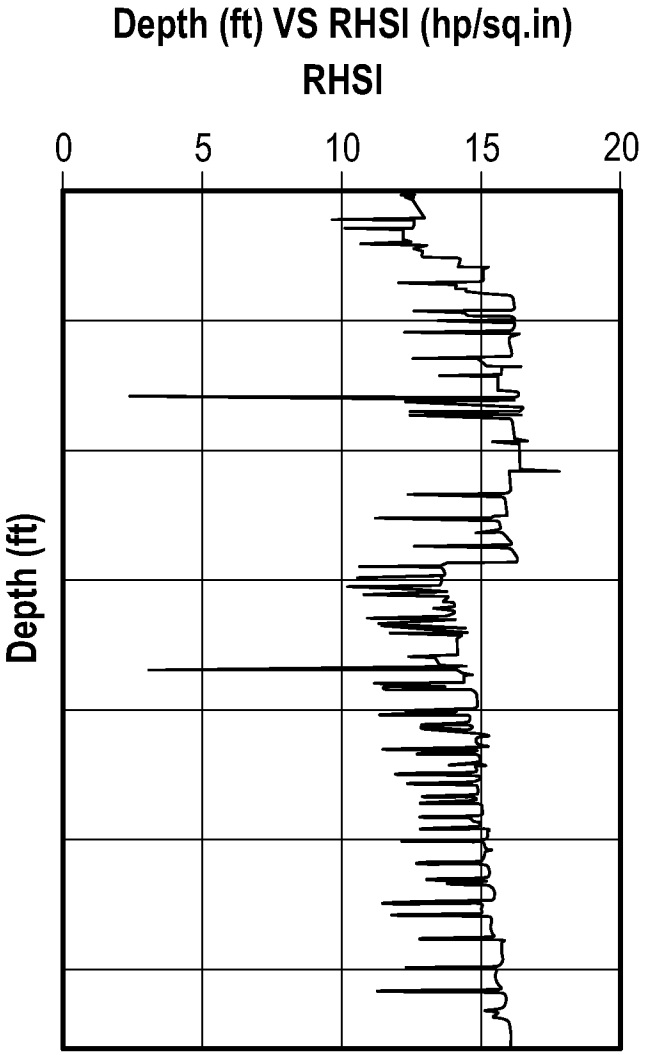
Figure 4N:
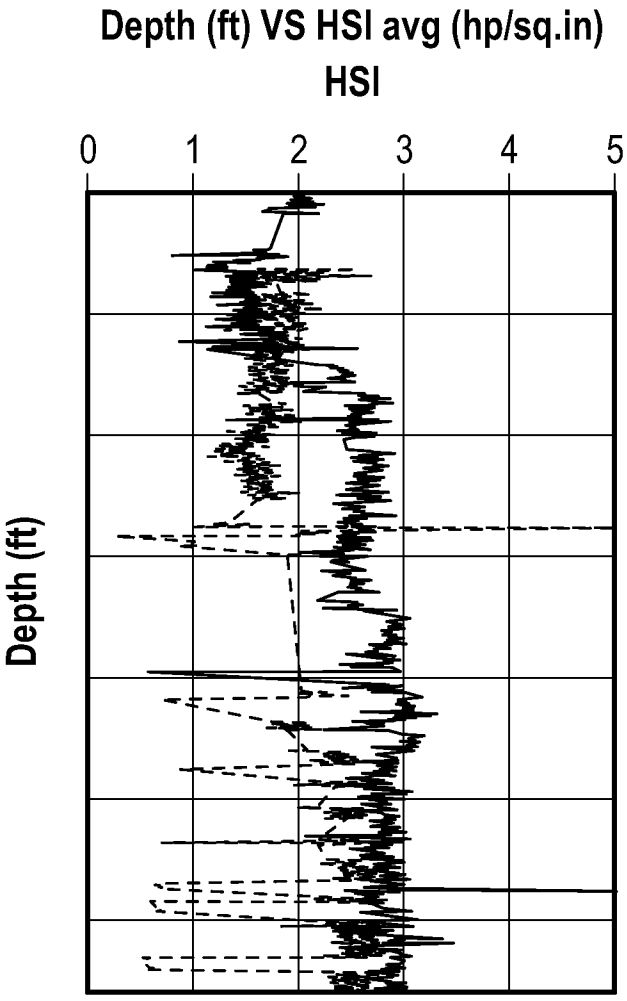
Figure 4M:
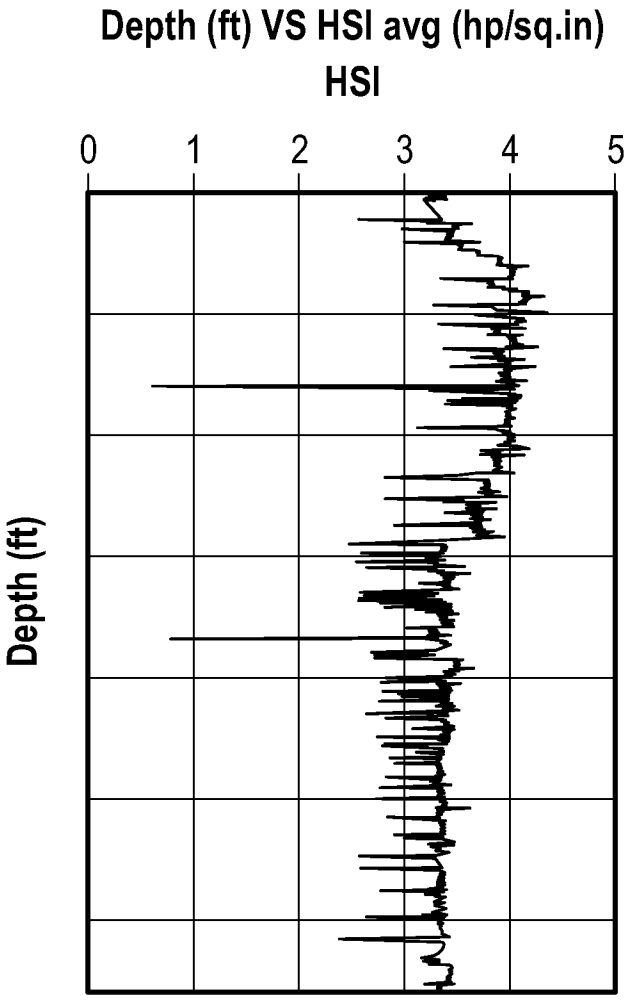
Figure 4O:
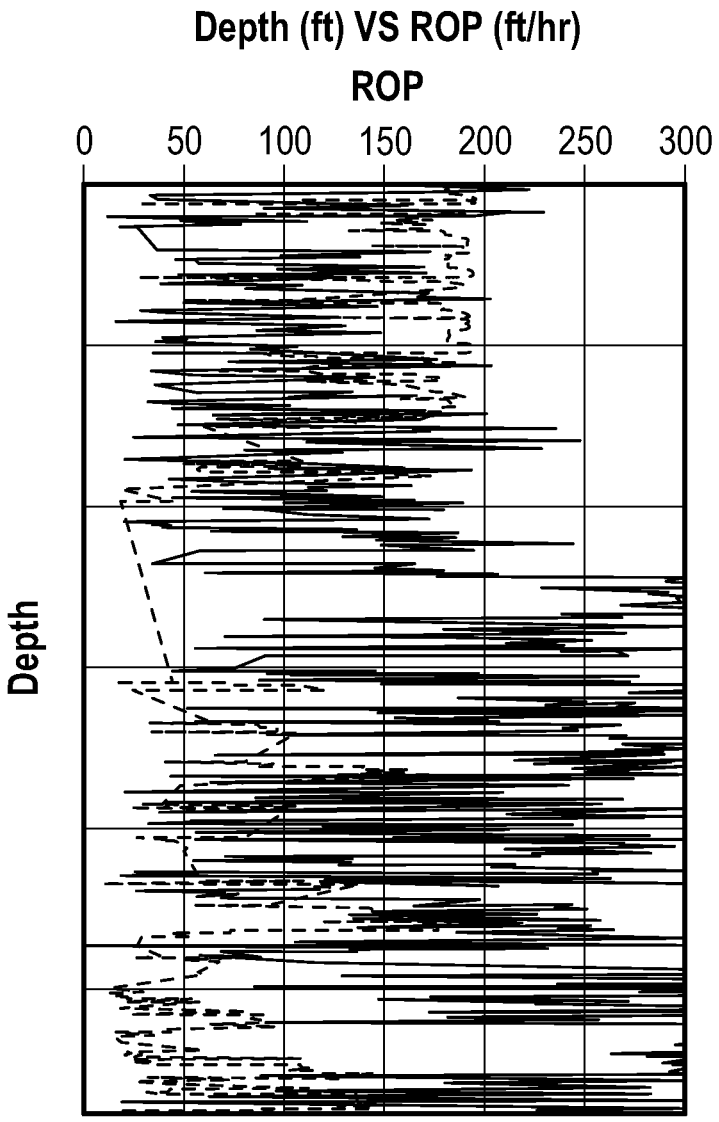
Figure 4P:
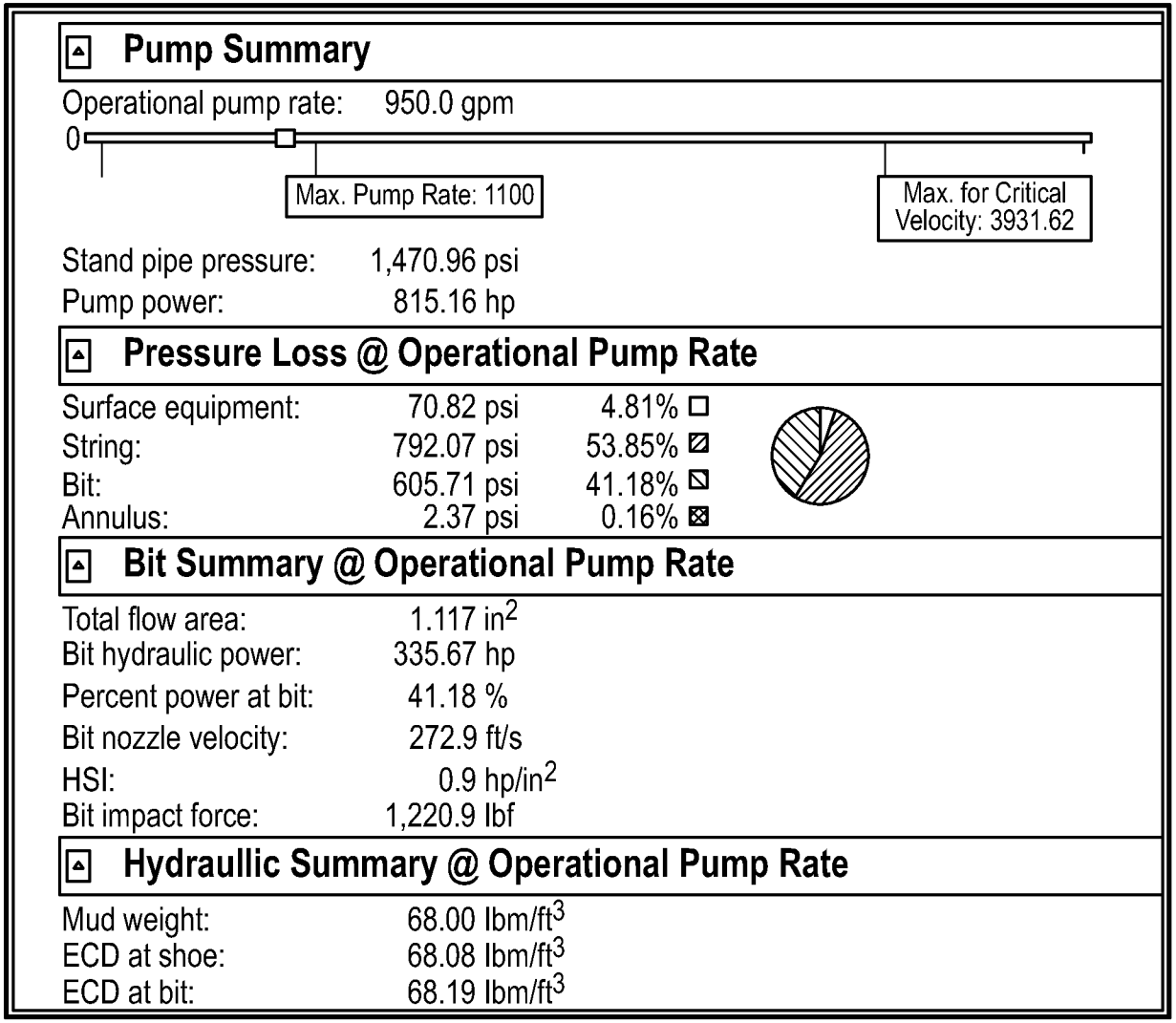
Figure 4Q:
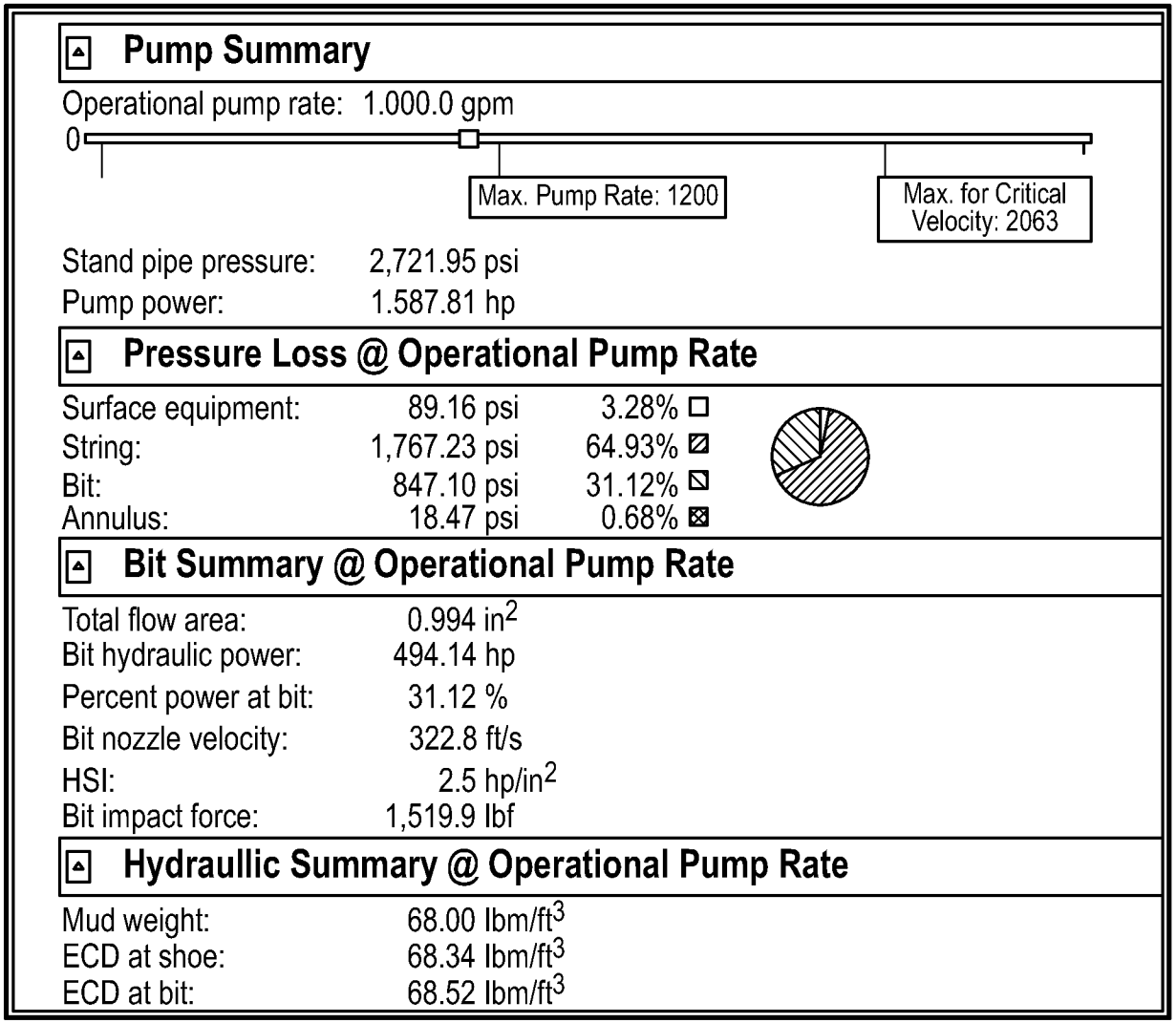

FIGS. 4A-4Q show an example in accordance with one or more embodiments. Specifically, FIGS. 4A-4Q illustrate a real-time model that is developed using real-time data driven approach as well as physic-based approach. The example shown in FIGS. 4A-4Q may be, for example, based on one or more components depicted in FIGS. 1A-1B, and 2, and the method flowchart depicted in FIG. 3A above. In one or more embodiments, one or more of the modules and/or elements shown in FIGS. 4A-4Q may be omitted, repeated, and/or substituted. Accordingly, embodiments disclosed herein should not be considered limited to the specific arrangements of modules and/or elements shown in FIGS. 4A-4Q.

FIGS. 4A-4F and FIGS. 4I-4M illustrate that the drilling hydraulics model automatically calculates the rat of penetration (ROP), hydraulics horsepower per square inch (HIS), force per square inch (FSI), rig hydraulics horsepower per square inch (RHSI), bit hydraulics horsepower per square inch (BHSI), and jet impact force per square inch (JIFSI). These real-time modeled hydraulics data represent the ability of the rig and bit to circulate the cuttings to the surface for smooth and proper optimized drilling rate with respect to the rig and bit efficiency and equipment limitations.

FIGS. 4G-4H and 4N-4O illustrate that the algorithmic model is validated with real-time data during actual drilling operations scenarios. In particular, FIGS. 4G and 4N show the modeled real time profiles of rig and bit hydraulics for offset wells and trial wells where the bit and rig hydraulics models are applied. The developed models applied to the offset wells show low values due to the low drilling performance. On the other hand, once the models are applied to trial wells with optimized drilling performance, the hydraulics models show high values or optimized real time profiles. That means the developed models are validated and tested on low performance offset wells and high performance trial wells. In addition, FIGS. 4H and 4O show two tracks of rate of penetration (ROP) or well drilling performance for two offset wells with high and low drilling performances.

FIGS. 4P-4Q show an example screenshot of the driller console where the modeled hydraulics information are displayed based on real-time measurements from the rig sensors. Specifically, the displayed information includes mud pump flow rate, pressure, and power, power loss at surface, drill string, drill bit, and annulus, drill bit power information, and hydraulics summary. The displayed information allows the driller to continuously monitor, evaluate, and advise hydraulics efficiency while drilling to avoid hole problems and to optimize well drilling performance. The real-time update of the displayed information allows for immediate intervention when the wellbore drilling performance is found to be inefficient.

Figure 5:
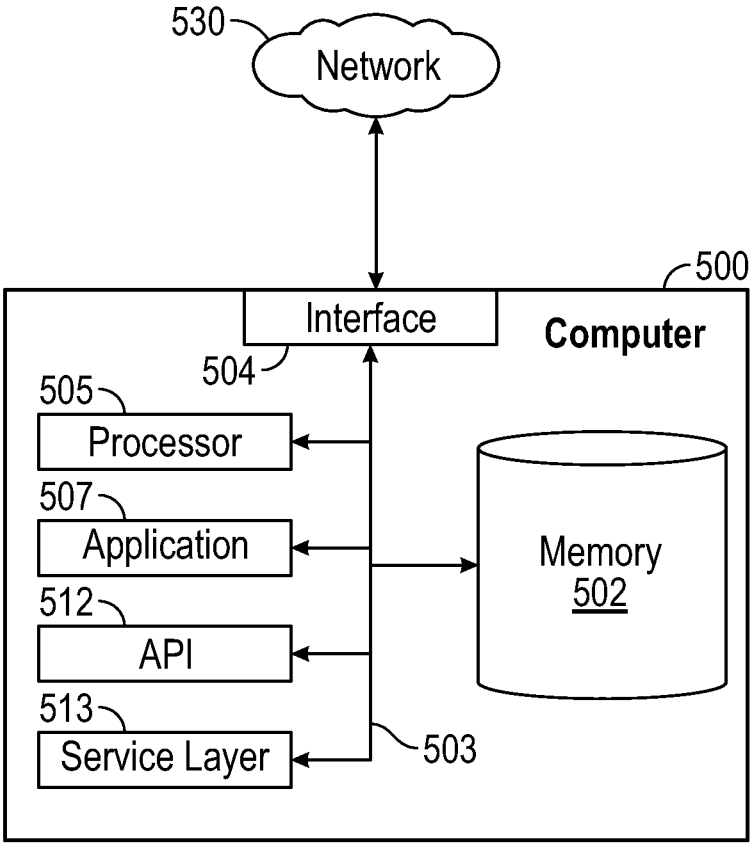
FIG. 5 show a computing system in accordance with one or more embodiments.

Embodiments may be implemented on a computer system. FIG. 5 is a block diagram of a computer system (500) used to provide computational functionalities associated with described algorithms, methods, functions, processes, flows, and procedures as described in the instant disclosure, according to an implementation. The illustrated computer (500) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (500) may include a computer that includes an input device, such as a keypad, keyboard, touch screen, or other device that can accept user information, and an output device that conveys information associated with the operation of the computer (500), including digital data, visual, or audio information (or a combination of information), or a GUI.

The computer (500) can serve in a role as a client, network component, a server, a database or other persistency, or any other component (or a combination of roles) of a computer system for performing the subject matter described in the instant disclosure. The illustrated computer (500) is communicably coupled with a network (530). In some implementations, one or more components of the computer (500) may be configured to operate within environments, including cloud-computing-based, local, global, or other environment (or a combination of environments).

At a high level, the computer (500) is an electronic computing device operable to receive, transmit, process, store, or manage data and information associated with the described subject matter. According to some implementations, the computer (500) may also include or be communicably coupled with an application server, e-mail server, web server, caching server, streaming data server, business intelligence (BI) server, or other server (or a combination of servers).

The computer (500) can receive requests over network (530) from a client application (for example, executing on another computer (500)) and responding to the received requests by processing the said requests in an appropriate software application. In addition, requests may also be sent to the computer (500) from internal users (for example, from a command console or by other appropriate access method), external or third-parties, other automated applications, as well as any other appropriate entities, individuals, systems, or computers.

Each of the components of the computer (500) can communicate using a system bus (503). In some implementations, any or all of the components of the computer (500), both hardware or software (or a combination of hardware and software), may interface with each other or the interface (504) (or a combination of both) over the system bus (503) using an application programming interface (API) (512) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (500) or other components (whether or not illustrated) that are communicably coupled to the computer (500). The functionality of the computer (500) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or other suitable format. While illustrated as an integrated component of the computer (500), alternative implementations may illustrate the API (512) or the service layer (513) as stand-alone components in relation to other components of the computer (500) or other components (whether or not illustrated) that are communicably coupled to the computer (500). Moreover, any or all parts of the API (512) or the service layer (513) may be implemented as child or sub-modules of another software module, enterprise application, or hardware module without departing from the scope of this disclosure.

The computer (500) includes an interface (504). Although illustrated as a single interface (504) in FIG. 5, two or more interfaces (504) may be used according to particular needs, desires, or particular implementations of the computer (500). The interface (504) is used by the computer (500) for communicating with other systems in a distributed environment that are connected to the network (530). Generally, the interface (504) includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (500).

The computer (500) includes at least one computer processor (505). Although illustrated as a single computer processor (505) in FIG. 5, two or more processors may be used according to particular needs, desires, or particular implementations of the computer (500). Generally, the computer processor (505) executes instructions and manipulates data to perform the operations of the computer (500) and any algorithms, methods, functions, processes, flows, and procedures as described in the instant disclosure.

The computer (500) also includes a memory (506) that holds data for the computer (500) or other components (or a combination of both) that may be connected to the network (530). For example, memory (506) may be a database storing data consistent with this disclosure. Although illustrated as a single memory (506) in FIG. 5, two or more memories may be used according to particular needs, desires, or particular implementations of the computer (500) and the described functionality. While memory (506) is illustrated as an integral component of the computer (500), in alternative implementations, memory (506) may be external to the computer (500).

The application (507) is an algorithmic software engine providing functionality according to particular needs, desires, or particular implementations of the computer (500), particularly with respect to functionality described in this disclosure. For example, application (507) can serve as one or more components, modules, applications, etc. Further, although illustrated as a single application (507), the application (507) may be implemented as multiple applications (507) on the computer (500). In addition, although illustrated as integral to the computer (500), in alternative implementations, the application (507) may be external to the computer (500).

There may be any number of computers (500) associated with, or external to, a computer system containing computer (500), each computer (500) communicating over network (530). Further, the term "client," "user," and other appropriate terminology may be used interchangeably as appropriate without departing from the scope of this disclosure. Moreover, this disclosure contemplates that many users may use one computer (500), or that one user may use multiple computers (500).

In some embodiments, the computer (500) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

While the disclosure has been described with respect to a limited number of embodiments, those skilled in the art, having benefit of this disclosure, will appreciate that other embodiments may be devised which do not depart from the scope of the disclosure as disclosed herein. Accordingly, the scope of the disclosure should be limited only by the attached claims.

What is claimed is:

1. A method for optimizing drilling performance of a drilling operation, the method comprising:

advancing a drill bit during the drilling operation of a well based on a plurality of drilling parameters comprising mud weight of drilling fluid, volume output and stroke per minute of a mud pump circulating the drilling fluid downhole through the drill bit to return cuttings to the Earth surface, rate of penetration, revolutions per minute, and weight on bit;

acquiring, using a plurality of sensors disposed throughout a rig of the well, sensor measurement data related to circulation of the drilling fluid and comprising a drilling fluid flow rate and a cutting concentration of the cuttings;

generating, using a drilling hydraulics model based on at least the sensor measurement data of the circulation of drilling fluid, modeled rig and bit hydraulics data comprising an equivalent mud weight, a pressure drop at the drill bit, and a bit hydraulic horsepower per square inch (BHSI), wherein the equivalent mud weight is calculated based on the mud weight and the cutting concentration, wherein the pressure drop at the drill bit is calculated based at least on multiplying the equivalent mud weight by the drilling fluid flow rate;

continuously updating the equivalent mud weight and the pressure drop at the drill bit based on the drilling fluid flow rate and the cutting concentration that are continuously changing in real-time while advancing the drill bit during the drilling operation;

computing, in real-time, the BHSI using the drilling fluid flow rate and the pressure drop at the drill bit; and adjusting, during the drilling operation and using the real-time computed BHSI, one or more values of the mud weight, the volume output and stroke per minute of the mud pump, the rate of penetration, the revolutions per minute, and the weight on bit to optimize drilling fluid hydraulics to circulate the cuttings to the Earth surface.

2. The method according to claim 1, further comprising:

directly sending the continuously updated modeled rig and bit hydraulics data to an automated drilling equipment without user intervention to perform the drilling operation;

displaying, on a driller console of the rig, the continuously updated modeled rig and bit hydraulics data as a real-time drilling hydraulics profile; and receiving, in response to the displayed real-time drilling hydraulics profile indicating that a wellbore is not being cleaned properly by the circulating drilling fluid, an input from the user to initiate an immediate intervention of the drilling operation.

3. The method according to claim 1, wherein said computing the BHSI comprises:

computing the equivalent mud weight (EMW) and a total flow area of nozzles (TFA) based on the drilling fluid flow rate (GPM) and the rate of penetration (ROP);

computing the pressure drop at the drill bit ($dP_b$) based on the EMW and the TFA; and computing a bit hydraulic horsepower (BHHP) based on the GPM and the $dP_b$, wherein the modeled BHSI is computed based on the BHHP.

4. The method according to claim 3, wherein said generating the modeled rig and bit hydraulics data further comprises:

computing a modeled rig hydraulic horsepower per square inch (RHSI) based on bit pressure loss data.

5. The method according to claim 4, wherein said generating the modeled rig and bit hydraulics data further comprises:

computing a jet impact force (Fj) based on the GPM, the $dP_b$, and the EMW.

6. The method according to claim 5, wherein said generating the modeled rig and bit hydraulics data further comprises:

computing a modeled hydraulic horsepower per square inch (HSI) based on the modeled RHSI.

7. The method according to claim 6, wherein said computing the modeled HSI comprises:

computing a modeled jet impact force per square inch (JIFSI), wherein the modeled HIS is computed further based on the modeled JIFSI.

8. A data gathering and analysis system for optimizing drilling performance of a drilling operation, comprising:

a processor; and a memory coupled to the processor and storing instruction, the instructions, when executed by the processor, comprising functionality for:

advancing a drill bit during the drilling operation of a well based on a plurality of drilling parameters comprising mud weight of drilling fluid, volume output and stroke per minute of a mud pump circulating the drilling fluid downhole through the drill bit to return cuttings to the Earth surface, rate of penetration, revolutions per minute, and weight on bit;

acquiring, using a plurality of sensors disposed throughout a rig of the well, sensor measurement data related to circulation of the drilling fluid and comprising a drilling fluid flow rate and a cutting concentration of the cuttings;

generating, using a drilling hydraulics model based on at least the sensor measurement data of the circulation of drilling fluid, modeled rig and bit hydraulics data comprising an equivalent mud weight, a pressure drop at the drill bit, and a bit hydraulic horsepower per square inch (BHSI), wherein the equivalent mud weight is calculated based on the mud weight and the cutting concentration, wherein the pressure drop at the drill bit is calculated based at least on multiplying the equivalent mud weight by the drilling fluid flow rate;

continuously updating the equivalent mud weight and the pressure drop at the drill bit based on the drilling fluid flow rate and the cutting concentration that are continuously changing in real-time while advancing the drill bit during the drilling operation;

computing, in real-time, the BHSI using the drilling fluid flow rate and the pressure drop at the drill bit; and adjusting, during the drilling operation and using the real-time computed BHSI, one or more values of the mud weight, the volume output and stroke per minute of the mud pump, the rate of penetration, the revolutions per minute, and the weight on bit to optimize drilling fluid hydraulics to circulate the cuttings to the Earth surface.

9. The data gathering and analysis system according to claim 8, the instructions, when executed by the processor, further comprising functionality for:

directly sending the continuously updated modeled rig and bit hydraulics data to an automated drilling equipment without user intervention to perform the drilling operation;

displaying, on a driller console of the rig, the continuously updated modeled rig and bit hydraulics data as a real-time drilling hydraulics profile; and receiving, in response to the displayed real-time drilling hydraulics profile indicating that a wellbore is not being cleaned properly by the circulating drilling fluid, an input from the user to initiate an immediate intervention of the drilling operation.

10. The data gathering and analysis system according to claim 9, wherein said computing the BHSI comprises:

computing the equivalent mud weight (EMW) and a total flow area of nozzles (TFA) based on the drilling fluid flow rate (GPM) and the rate of penetration (ROP);

computing the pressure drop at the drill bit ($dP_b$) based on the EMW and the TFA; and computing a bit hydraulic horsepower (BHHP) based on the GPM and the $dP_b$, wherein the modeled BHSI is computed based on the BHHP.

11. The data gathering and analysis system according to claim 10, wherein said generating the modeled rig and bit hydraulics data further comprises:

computing a modeled rig hydraulic horsepower per square inch (RHSI) based on bit pressure loss data.

12. The data gathering and analysis system according to claim 11, wherein said generating the modeled rig and bit hydraulics data further comprises:

computing a jet impact force (Fj) based on the GPM, the $dP_b$, and the EMW.

13. The data gathering and analysis system according to claim 12, wherein said generating the modeled rig and bit hydraulics data further comprises:

computing a modeled hydraulic horsepower per square inch (HSI) based on the modeled RHSI.

14. The data gathering and analysis system according to claim 13, wherein said computing the modeled HIS comprises:

computing a modeled jet impact force per square inch (JIFSI), wherein the modeled HIS is computed further based on the modeled JIFSI.

15. A wellsite for performing a drilling operation of a well, comprising:

a rig having a plurality of drilling equipment of the well installed with a plurality of sensors; and a data gathering and analysis system comprising functionality for:

advancing a drill bit during the drilling operation of a well based on a plurality of drilling parameters comprising mud weight of drilling fluid, volume output and stroke per minute of a mud pump circulating the drilling fluid downhole through the drill bit to return cuttings to the Earth surface, rate of penetration, revolutions per minute, and weight on bit;

acquiring, using a plurality of sensors disposed throughout a rig of the well, sensor measurement data related to circulation of the drilling fluid and comprising a drilling fluid flow rate and a cutting concentration of the cuttings;

generating, using a drilling hydraulics model based on at least the sensor measurement data of the circulation of drilling fluid, modeled rig and bit hydraulics data comprising an equivalent mud weight, a pressure drop at the drill bit, and a bit hydraulic horsepower per square inch (BHSI), wherein the equivalent mud weight is calculated based on the mud weight and the cutting concentration, wherein the pressure drop at the drill bit is calculated based at least on multiplying the equivalent mud weight by the drilling fluid flow rate;

continuously updating the equivalent mud weight and the pressure drop at the drill bit based on the drilling fluid flow rate and the cutting concentration that are continuously changing in real-time while advancing the drill bit during the drilling operation;

computing, in real-time, the BHSI using the drilling fluid flow rate and the pressure drop at the drill bit; and adjusting, during the drilling operation and using the real-time computed BHSI, one or more values of the mud weight, the volume output and stroke per minute of the mud pump, the rate of penetration, the revolutions per minute, and the weight on bit to optimize drilling fluid hydraulics to circulate the cuttings to the Earth surface.

16. The wellsite according to claim 15, the data gathering and analysis system further comprising functionality for:

directly sending the continuously updated modeled rig and bit hydraulics data to an automated drilling equipment without user intervention to perform the drilling operation;

displaying, on a driller console of the rig, the continuously updated modeled rig and bit hydraulics data as a real-time drilling hydraulics profile; and receiving, in response to the displayed real-time drilling hydraulics profile indicating that a wellbore is not being cleaned properly by the circulating drilling fluid, an input from the user to initiate an immediate intervention of the drilling operation.

17. The wellsite according to claim 15, wherein said computing the modeled BHSI comprises:

computing the equivalent mud weight (EMW) and a total flow area of nozzles (TFA) based on the drilling fluid flow rate (GPM) and the rate of penetration (ROP);

computing the pressure drop at the drill bit ($dP_b$) based on the EMW and the TFA; and computing a bit hydraulic horsepower (BHHP) based on the GPM and the $dP_b$, wherein the modeled BHSI is computed based on the BHHP.

18. The wellsite according to claim 17, wherein said generating the modeled rig and bit hydraulics data further comprises:

computing a modeled rig hydraulic horsepower per square inch (RHSI) based on bit pressure loss data.

19. The wellsite according to claim 18, wherein said generating the modeled rig and bit hydraulics data further comprises:

computing a jet impact force (Fj) based on the GPM, the $dP_b$, and the EMW.

20. The wellsite according to claim 19, wherein said generating the modeled rig and bit hydraulics data further comprises:

computing a modeled jet impact force per square inch (JIFSI); and computing a modeled hydraulic horsepower per square inch (HSI) based on the modeled RHSI and the modeled JIFSI.

* * * * *